US007207846B2

(12) United States Patent
Caveney et al.

(10) Patent No.: US 7,207,846 B2
(45) Date of Patent: Apr. 24, 2007

(54) PATCH PANEL WITH A MOTHERBOARD FOR CONNECTING COMMUNICATION JACKS

(75) Inventors: Jack E. Caveney, Hinsdale, IL (US); Ronald A. Nordin, Naperville, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 10/997,600

(22) Filed: Nov. 23, 2004

(65) Prior Publication Data

US 2005/0159036 A1 Jul. 21, 2005

Related U.S. Application Data

(60) Provisional application No. 60/537,126, filed on Jan. 16, 2004, provisional application No. 60/529,925, filed on Dec. 16, 2003, provisional application No. 60/524,654, filed on Nov. 24, 2003.

(51) Int. Cl.
*H01R 24/00* (2006.01)

(52) U.S. Cl. ..... 439/676

(58) Field of Classification Search ..... 439/676, 439/49, 354, 540.1, 668
See application file for complete search history.

(56) References Cited

U.S. PATENT DOCUMENTS

| | | | |
|---|---|---|---|
| 3,771,098 | A | 11/1973 | Dempsey |
| 4,479,228 | A | 10/1984 | Crane |
| 4,767,181 | A | 8/1988 | McEowen |
| 4,937,825 | A | 6/1990 | Ballard et al. |
| 5,081,627 | A | 1/1992 | Yu |
| 5,161,988 | A | 11/1992 | Krupka |
| 5,170,272 | A | 12/1992 | Onno |
| 5,222,164 | A | 6/1993 | Bass, Sr. et al. |
| 5,226,120 | A | 7/1993 | Brown et al. |
| 5,233,501 | A | 8/1993 | Allen et al. |
| 5,282,270 | A | 1/1994 | Oppenheimer et al. |
| 5,293,635 | A | 3/1994 | Faulk, Jr. et al. |
| 5,421,024 | A | 5/1995 | Faulk, Jr. et al. |
| 5,437,046 | A | 7/1995 | Bright et al. |
| 5,483,467 | A | 1/1996 | Krupka et al. |

(Continued)

FOREIGN PATENT DOCUMENTS

| | | |
|---|---|---|
| EP | 0 689 696 | 1/1996 |

(Continued)

OTHER PUBLICATIONS

U.S. Appl. No. 10/910,899, filed Aug. 3, 2004, Caveney et al.

(Continued)

*Primary Examiner*—Chandrika Prasad
(74) *Attorney, Agent, or Firm*—Robert A. McCann; Zachary J. Smolinski; Anthony P. Curtis

(57) ABSTRACT

An active jack, which is a powered device, is installed as the network connection at a workstation which provides the capability to determine the physical location of a destination device, such as a VOIP phone, in real time. Uninterruptible power supplies may be used to provide power to network components, for example during an emergency. Power-and-data deployments are shown for powering network components and destination devices.

12 Claims, 33 Drawing Sheets

U.S. PATENT DOCUMENTS

| | | | |
|---|---|---|---|
| 5,521,902 | A | 5/1996 | Ferguson |
| 5,526,489 | A | 6/1996 | Nilakantan et al. |
| 5,559,955 | A | 9/1996 | Dev et al. |
| 5,572,640 | A | 11/1996 | Schettler |
| 5,577,105 | A | 11/1996 | Baum et al. |
| 5,606,664 | A | 2/1997 | Brown et al. |
| 5,613,873 | A | 3/1997 | Bell, Jr. |
| 5,636,138 | A | 6/1997 | Gilbert et al. |
| 5,649,001 | A | 7/1997 | Thomas et al. |
| 5,684,796 | A | 11/1997 | Abidi et al. |
| 5,684,959 | A | 11/1997 | Bhat et al. |
| 5,706,440 | A | 1/1998 | Compliment et al. |
| 5,736,910 | A | 4/1998 | Townsend et al. |
| 5,742,672 | A | 4/1998 | Burk |
| 5,745,682 | A | 4/1998 | Keenan |
| 5,761,281 | A | 6/1998 | Baum et al. |
| 5,764,043 | A | 6/1998 | Czosnowski et al. |
| 5,790,041 | A | 8/1998 | Lee |
| 5,793,975 | A | 8/1998 | Zeldin |
| 5,797,767 | A | 8/1998 | Schell |
| 5,841,842 | A | 11/1998 | Baum et al. |
| 5,847,557 | A | 12/1998 | Fincher et al. |
| 5,854,824 | A | 12/1998 | Bengal et al. |
| 5,870,626 | A | 2/1999 | Lebeau |
| 5,898,837 | A | 4/1999 | Guttman et al. |
| 5,909,429 | A | 6/1999 | Satyanarayana et al. |
| 5,960,416 | A | 9/1999 | Block |
| 5,994,998 | A | 11/1999 | Fisher et al. |
| 6,014,667 | A | 1/2000 | Jenkins et al. |
| 6,041,352 | A | 3/2000 | Burdick et al. |
| 6,055,236 | A | 4/2000 | Nessett et al. |
| 6,058,412 | A | 5/2000 | Kojima et al. |
| 6,131,119 | A | 10/2000 | Fukui |
| 6,140,911 | A | 10/2000 | Fisher et al. |
| 6,152,762 | A | 11/2000 | Marshall et al. |
| 6,157,925 | A | 12/2000 | Jenkins et al. |
| 6,178,438 | B1 | 1/2001 | Tschirhart et al. |
| 6,205,122 | B1 | 3/2001 | Sharon et al. |
| 6,211,796 | B1 | 4/2001 | Toms et al. |
| 6,212,206 | B1 | 4/2001 | Ketcham |
| 6,222,908 | B1 | 4/2001 | Bartolutti et al. |
| 6,222,910 | B1 | 4/2001 | Price et al. |
| 6,224,417 | B1 | 5/2001 | Belopolsky et al. |
| 6,272,541 | B1 | 8/2001 | Cromer et al. |
| 6,283,775 | B1 | 9/2001 | Shupe et al. |
| 6,289,370 | B1 | 9/2001 | Panarello et al. |
| 6,317,597 | B1 | 11/2001 | Baker et al. |
| 6,327,623 | B2 | 12/2001 | Watts |
| 6,329,906 | B1 | 12/2001 | Fisher et al. |
| 6,363,423 | B1 | 3/2002 | Chiles et al. |
| 6,367,018 | B1 | 4/2002 | Jain |
| 6,368,159 | B1 | 4/2002 | Hess et al. |
| 6,393,474 | B1 | 5/2002 | Eichert et al. |
| 6,397,249 | B1 | 5/2002 | Cromer et al. |
| 6,405,236 | B1 | 6/2002 | Nieratschker |
| 6,421,322 | B1 | 7/2002 | Koziy et al. |
| 6,421,376 | B1 | 7/2002 | Williams et al. |
| 6,428,330 | B1 | 8/2002 | Poulter et al. |
| 6,430,286 | B1 | 8/2002 | Bhusri |
| 6,431,892 | B1 | 8/2002 | Shupe et al. |
| 6,438,429 | B1 | 8/2002 | Ho et al. |
| 6,438,695 | B1 | 8/2002 | Maufer |
| 6,442,161 | B1 | 8/2002 | Drummond-Murray et al. |
| 6,446,127 | B1 | 9/2002 | Schuster et al. |
| 6,449,348 | B1 | 9/2002 | Lamb et al. |
| 6,457,992 | B2 | 10/2002 | Posey et al. |
| 6,457,993 | B1 | 10/2002 | Espenshade |
| 6,483,712 | B1 | 11/2002 | Oliphant et al. |
| 6,496,105 | B2 | 12/2002 | Fisher et al. |
| 6,496,859 | B2 | 12/2002 | Roy et al. |
| 6,523,070 | B1 | 2/2003 | Stapleton et al. |
| 6,535,983 | B1 | 3/2003 | McCormack et al. |
| 6,563,824 | B1 | 5/2003 | Bhatia et al. |
| 6,570,974 | B1 | 5/2003 | Gerszberg et al. |
| 6,574,481 | B1 | 6/2003 | Rathnasabapathy et al. |
| 6,577,622 | B1 | 6/2003 | Schuster et al. |
| 6,580,697 | B1 | 6/2003 | Gardner et al. |
| 6,580,785 | B2 | 6/2003 | Bremer et al. |
| 6,587,454 | B1 | 7/2003 | Lamb |
| 6,594,231 | B1 | 7/2003 | Byham et al. |
| 6,594,707 | B1 | 7/2003 | Rubinstein et al. |
| 6,601,097 | B1 | 7/2003 | Cheston et al. |
| 6,603,741 | B1 | 8/2003 | Poulter et al. |
| 6,611,580 | B1 | 8/2003 | Dahan et al. |
| 6,614,781 | B1 | 9/2003 | Elliott et al. |
| 6,614,785 | B1 | 9/2003 | Huai et al. |
| 6,628,623 | B1 | 9/2003 | Noy |
| 6,632,106 | B2 * | 10/2003 | Musolf et al. ..... 439/668 |
| 6,638,112 | B1 | 10/2003 | Walker et al. |
| 6,646,656 | B1 | 11/2003 | Walker et al. |
| 6,650,901 | B1 | 11/2003 | Schuster et al. |
| 6,654,387 | B1 | 11/2003 | Beser et al. |
| 6,657,991 | B1 | 12/2003 | Akgun et al. |
| 6,665,611 | B1 | 12/2003 | Oran et al. |
| 6,674,745 | B1 | 1/2004 | Schuster et al. |
| 6,675,308 | B1 | 1/2004 | Thomsen |
| 6,678,250 | B1 | 1/2004 | Grabelsky et al. |
| 6,678,357 | B2 | 1/2004 | Stumer et al. |
| 6,678,728 | B1 | 1/2004 | Uppunda et al. |
| 6,681,252 | B1 | 1/2004 | Schuster et al. |
| 6,691,147 | B1 | 2/2004 | Arunkumar et al. |
| 6,691,161 | B1 | 2/2004 | Cook et al. |
| 6,691,256 | B1 | 2/2004 | Cook et al. |
| 6,697,339 | B1 | 2/2004 | Jain |
| 6,697,354 | B1 | 2/2004 | Borella et al. |
| 6,697,862 | B1 | 2/2004 | Beser et al. |
| 6,704,292 | B1 | 3/2004 | Valentine et al. |
| 6,711,162 | B1 | 3/2004 | Ortega et al. |
| 6,717,914 | B1 | 4/2004 | Hamami |
| 6,718,030 | B1 | 4/2004 | Turner et al. |
| 6,751,230 | B1 | 6/2004 | Vogel et al. |
| 6,753,761 | B2 | 6/2004 | Fisher et al. |
| 6,754,310 | B1 | 6/2004 | Steinbrenner et al. |
| 6,754,622 | B1 | 6/2004 | Beser et al. |
| 6,763,001 | B1 | 7/2004 | Jones et al. |
| 6,763,018 | B1 | 7/2004 | Puthiyandyil et al. |
| 6,763,023 | B1 | 7/2004 | Gleeson et al. |
| 2001/0029534 | A1 | 10/2001 | Spinks et al. |
| 2001/0047407 | A1 | 11/2001 | Moore et al. |
| 2001/0056500 | A1 | 12/2001 | Farber et al. |
| 2002/0021209 | A1 | 2/2002 | Fisher et al. |
| 2002/0032787 | A1 | 3/2002 | Overton et al. |
| 2002/0049857 | A1 | 4/2002 | Farber et al. |
| 2002/0055995 | A1 | 5/2002 | Beckwith et al. |
| 2002/0059416 | A1 | 5/2002 | Tuunanen |
| 2002/0062366 | A1 | 5/2002 | Roy et al. |
| 2002/0083426 | A1 | 6/2002 | Sistla |
| 2002/0085538 | A1 | 7/2002 | Leung |
| 2002/0087678 | A1 | 7/2002 | Padilla |
| 2002/0089960 | A1 | 7/2002 | Shuster |
| 2002/0099787 | A1 | 7/2002 | Bonner et al. |
| 2002/0101817 | A1 | 8/2002 | Teixeira |
| 2002/0101818 | A1 | 8/2002 | Teixeira |
| 2002/0120773 | A1 | 8/2002 | Caveney |
| 2002/0129295 | A1 | 9/2002 | Nishioka et al. |
| 2002/0131374 | A1 | 9/2002 | Lee |
| 2002/0136360 | A1 | 9/2002 | Stumer |
| 2002/0143991 | A1 | 10/2002 | Chow et al. |
| 2002/0156916 | A1 | 10/2002 | Watanabe |
| 2002/0161885 | A1 | 10/2002 | Childers et al. |
| 2002/0171581 | A1 | 11/2002 | Sheynblat et al. |
| 2002/0176386 | A1 | 11/2002 | Singh |
| 2002/0182938 | A1 | 12/2002 | Fuller |
| 2002/0187781 | A1 | 12/2002 | Furlong |

| | | | |
|---|---|---|---|
| 2002/0188759 | A1 | 12/2002 | Roy et al. |
| 2002/0188842 | A1 | 12/2002 | Willeby |
| 2002/0198991 | A1 | 12/2002 | Gopalakrishnan et al. |
| 2003/0014514 | A1 | 1/2003 | Saito et al. |
| 2003/0014548 | A1 | 1/2003 | Valentine et al. |
| 2003/0018704 | A1 | 1/2003 | Polychronidis et al. |
| 2003/0041238 | A1 | 2/2003 | French et al. |
| 2003/0048878 | A1 | 3/2003 | Drury et al. |
| 2003/0056153 | A1 | 3/2003 | Beer et al. |
| 2003/0058085 | A1 | 3/2003 | Fisher et al. |
| 2003/0062991 | A1 | 4/2003 | Fisher et al. |
| 2003/0067881 | A1 | 4/2003 | Lunt et al. |
| 2003/0087650 | A1 | 5/2003 | Aarnio |
| 2003/0115260 | A1 | 6/2003 | Edge |
| 2003/0134599 | A1 | 7/2003 | Pangrac et al. |
| 2003/0140277 | A1 | 7/2003 | Beer et al. |
| 2003/0147412 | A1 | 8/2003 | Weyman et al. |
| 2003/0154273 | A1 | 8/2003 | Caveney |
| 2003/0154276 | A1 | 8/2003 | Caveney |
| 2003/0154307 | A1 | 8/2003 | Puthiyandyil et al. |
| 2003/0159066 | A1 | 8/2003 | Staw et al. |
| 2003/0163581 | A1 | 8/2003 | Moran et al. |
| 2003/0204356 | A1 | 10/2003 | David et al. |
| 2004/0057425 | A1 | 3/2004 | Brouwer et al. |
| 2004/0073597 | A1 | 4/2004 | Caveney et al. |

FOREIGN PATENT DOCUMENTS

| | | | |
|---|---|---|---|
| EP | 1 152 569 | A3 | 11/2001 |
| EP | 1 422 884 | A1 | 5/2004 |
| FR | 2 680 067 | A1 | 2/1993 |
| GB | 2 236 398 | A | 4/1991 |
| WO | WO 98/03921 | | 1/1998 |
| WO | WO 00/60475 | | 10/2000 |
| WO | WO 01/65763 | A2 | 9/2001 |
| WO | WO 02/10942 | A1 | 2/2002 |
| WO | WO 02/47331 | A2 | 6/2002 |
| WO | WO 02/076018 | A2 | 9/2002 |

OTHER PUBLICATIONS

U.S. Appl. No. 10/969,863, filed Oct. 22, 2004, Caveney.
Cisco "Catalyst Inline Power Patch Panel" Data Sheet; May 2000.
3COM User Guide—3COM Network Jack—Model NJ200; Sep. 2002.
AVAYA Solving the Challenges of E911 Service with Avaya IP Telephony Networks; Nov. 2002.
TRENDS 911 over VoIP: whose responsibility?—Communications News; Jul. 2004.
Panduit—Discover the PANVIEW Solution; Jul. 2003.
3COM NJ200 Network Jack Management Feature: Location Mapping; Sep. 2003.
3COM Solution Case Studies: University of Utah Hospital.
3COM Product Details—3COM NBX 100 Communications System.
3COM Unveils Next Generation of Internet Protocol Business Phone—Press Release; Mar. 4, 2004.
3COM Product Details—3COM Network Jack & IntelliJack Switch Family Overview.
3COM Application Guide—Expanding User Connectivity in Education; Feb. 2004.
3COM Data Sheet—3COM Network Jacks; Dec. 2003.
3COM Small Office Solutions—A Guide to Small Office Networking; Sep. 2003.
3COM and Siemon to Deliver World-Class Connectivity—Press Release; Apr. 13, 2004.
3COM Product Details—3COM SuperStack 3 NBX Networked Telephony Solution.
3COM Product Details—3COM Guardian Service.
3COM Product Details—3COM Power over Ethernet Multiport Midspan Solution.
3COM Product Details—3COM Network Jack NJ200.

* cited by examiner

PATCH PANEL WITH A MOTHERBOARD FOR CONNECTING COMMUNICATION JACKS

CROSS-REFERENCE TO RELATED APPLICATION

This application claims the benefit of U.S. Provisional Patent Application Ser. No. 60/524,654, filed Nov. 24, 2003 and entitled "Communications Patch Panel Systems and Methods," U.S. Provisional Patent Application Ser. No. 60/529,925, filed Dec. 16, 2003 and entitled "Communications Patch Panel Systems and Methods," and U.S. Provisional Patent Application Ser. No. 60/537,126, filed Jan. 16, 2004 and entitled "Communications Patch Panel Systems and Methods,".

INCORPORATION BY REFERENCE

This application incorporates by reference in its entirety U.S. patent application Ser. No. 10/439,716, entitled "Systems and Methods for Managing a Network," filed on May 16, 2003; U.S. Provisional Application Ser. No. 60/492,822, entitled "Network Managed Device Installation and Provisioning Technique," filed on Aug. 6, 2003; U. S. Provisional Application, entitled "System to Guide and Monitor the Installation and Revision of Network Cabling of an Active Jack Network System," filed Oct. 23, 2003; and U.S. Provisional Application Ser. No. 60/529,925, entitled "Communications Patch Panel Systems and Methods," filed Dec. 16, 2003, as well as all materials incorporated therein by reference.

BACKGROUND OF THE INVENTION

Prior art systems do not provide real time documentation of every power device, PD, connected to a network including PDs which can be moved from one physical location to another, i.e., a VOIP telephone.

Installation and maintenance of communications patch panels are complex processes that generally require the work of highly skilled installers and network managers. Further, connecting communications cables to communications patch panels generally requires detailed instructions and great care on the part of an installer. It is desirable to provide a communications patch panel that simplifies the process of installing and maintaining a patch panel and further simplifies the routing of communications cables to and from patch panels.

The present invention is directed to systems and methods that facilitate the installation of communications cabling and communications patch panels. Systems and methods of the present invention further facilitate the maintenance and revision of installed cable and the maintenance of communications patch panels.

SUMMARY OF THE INVENTION

This invention provides a dynamic real time system that documents which power devices, hereinafter called PDs, are connected on each path of a network. This is invaluable for critical functions including maintenance of service, planning of revisions, execution of revisions, diagnosis of problems, and determination of the physical location of a VOIP phone from which an emergency call was made.

Prior art systems provide such information, however, they do not provide reliable documentation in real time.

According to one embodiment of the present invention, an active jack, which is a PD, is installed as the network connection at a workstation in combination with a patch panel which contains an active jack, which is a PD, said active jacks being part of the same network path.

According to another embodiment of the present invention, an active jack which is the only active jack which is part of a network path is installed as the network connection at a workstation.

According to another embodiment of the present invention, systems and methods are provided by which a communications patch panel is provided with a number of active jacks for enhancing communications network installation, revision, management and documentation.

According to another embodiment of the present invention, a communications patch panel is provided with a motherboard that contains some common components and/or power connections for active jacks.

According to another embodiment of the present invention, a patch panel is provided in which modular jacks may be inserted or removed, with at least some necessary electronics for certain modular jacks being provided within the patch panel.

According to another embodiment of the present invention, several types of modular jacks are provided, including twisted-pair active jacks, and fiber optic active jacks.

Patch panels according to the present invention may be equipped to provide power to a jack in the patch panel and/or to a PD which is connected to said jack by twisted pair cables.

Figure 1:
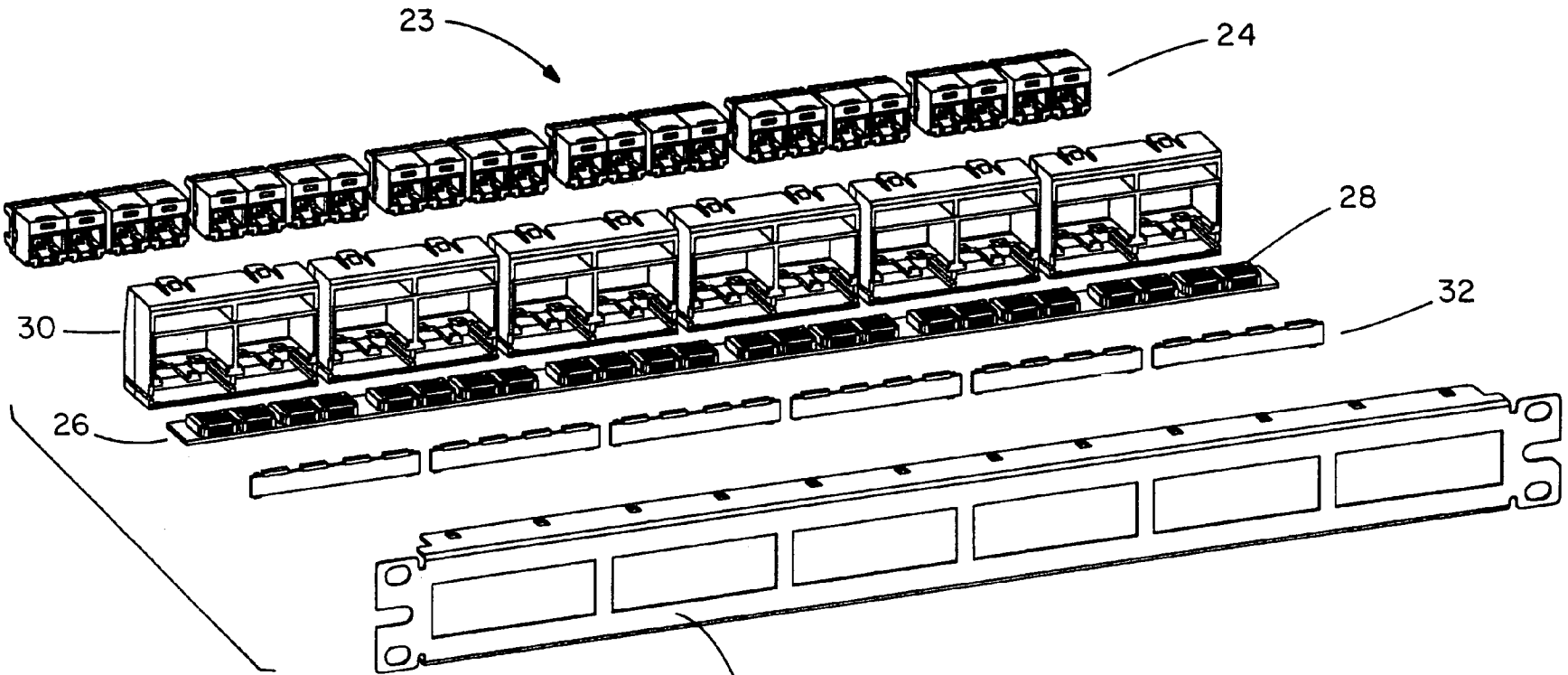
FIG. 1 is an exploded view of a patch panel.

While the invention is susceptible to various modifications and alternative forms, specific embodiments are shown by way of example in the drawings and are described in detail herein. However, it should be understood that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE ILLUSTRATED EMBODIMENTS

Active jacks according to the present invention may be considered Ethernet network repeaters that contain media access control (MAC) ID chips and that respond to query signals from a network source with the ID of the jack. They also provide functions required by various standards for PDs. They optionally provide additional functions as described in the above-referenced U.S. patent application Ser. No. 10/439,716. When active jacks are installed, their physical locations are recorded in a network system. When a response from a network information query is received on a particular source of a network path (i.e., a particular port of a switch), the system software combines this information with the above-described physical location information and documents network physical structure.

Active jacks according to the present invention may be provided in several varieties. A standard active jack ("A-Jack") is the jack to which a destination device (e.g., a voice-over-Internet-protocol (VOIP) telephone) is connected. A patch panel active jack ("P-Jack") is a jack on a patch panel. In a preferred embodiment, a P-Jack patch panel incorporates a "mother" printed circuit board to which each P-Jack module is electrically connected. Local power is optionally supplied through the motherboard. In addition, common electronic elements of P-Jacks are located on the motherboard.

One type of A-Jacks and P-Jacks, which may be termed twisted-pair active jacks, have a twisted-pair input and output. Another type of A-Jacks and P-Jacks includes an integral media converter and connects between twisted-pair and fiber optic plugs; these may be termed fiber optic active jacks.

In preferred embodiments, active jacks support different Ethernet systems. One supports 10 Base T and 100 Base TX. Another supports 1 GbE (1000 Base T).

Active jacks require power which can be supplied locally or, for twisted-pair active jacks, may be supplied by signal cables. According to one embodiment, power for fiber optic active jacks is supplied locally. If power is supplied locally to an A-Jack by a local power supply (called a brick), a preferred embodiment uses a 5-pair combination signal and power patch cord connected between the A-Jack and the workstation location.

The active jack system facilitates the real-time documentation of a complete network and preferred embodiments facilitate installation and revision. A prior art installation method includes conforming to a physical design in which the location of each element of a network is specified. A system to guide the installation and revision is provided which facilitates this installation method. An alternative and preferred method which can be used with the active jack system is to install each element of a group in random locations and subsequently to document the installation. For example, all connections from a switch to a patch panel can be randomly connected. All patch cords for a group can be randomly connected. All horizontal cables of a group can be randomly connected on the downstream patch panel.

In another embodiment, A-Jacks are employed in a network with or without P-Jacks. This is utilized, for example, in a "911 location" system. The system knows what the fixed physical location of each A-Jack is. The system also knows which network path each A Jack was connected to the last time a network information query was made and therefore deduces the physical location of a 911 call received on the same network path as the A-Jack. Queries can be made frequently, when a 911 call is received, or both.

As previously noted, power for twisted-pair active jacks can be supplied by the signal cables. In some cases, such power is supplied from the switch. When such power is not supplied from the switch in this embodiment, it can be supplied locally, by a so-called brick. However, it is preferable to supply it by the signal cables. Such power can be supplied for 10 Base T/100 Base TX Ethernet networks by a patch panel with passive jacks which supplies power downstream. A preferred embodiment of such a patch panel incorporates a motherboard to which each passive jack module is electrically connected.

Such power for a 1 GbE Ethernet network, which utilizes four twisted pairs for signals, cannot be supplied by such a patch panel with passive jacks because it is a mid-span device and the specifications do not allow power to be added to signal-carrying pairs by a mid-span device. It should be noted that active patch panels are permitted under the specification to supply downstream power because they are repeaters, which regenerate the signals.

A 911-location system may be employed in which a VOIP phone that is a PD device (that is, a device which requires power) is connected to an A-Jack. The VOIP phone gets its power from the signal cables or from a local power supply (a so-called brick). In either case, when a VOIP phone is first installed or is installed in a new location, the power to it goes from off to on. The power to it also goes from off to on if any part of the network path it is on, e.g., a patch cord, has been changed. When the power to it goes from off to on, the VOIP phone sends an ARP (address resolution protocol) message containing its unique I.D. number on the network. In the same way, when the power to an A Jack goes from off to on, the A Jack sends an ARP message containing its unique ID number on the network. The network system knows what network path these ARP messages are received on. The network system also knows the physical location of each A-Jack. This system therefore always knows the physical location of each VOIP phone.

Network Information queries to entire networks are typically made at intervals, e.g., several times a day. However, a preferred 911-location system will be programmed to send a network information query each time a VOIP phone sends an ARP message which wasn't in response to a network information query. This preferred system therefore always knows which VOIP phone is connected to which A-Jack and always knows the physical location of each VOIP phone.

P-Jack patch panels are provided in some embodiments of the present invention. In a preferred embodiment, P-Jack patch panels are modular. A patch panel structure incorporates a mother PCB and P-Jack modules snap into and out of the patch panel. Each patch panel supports any combination of 10 Base T, 100 Base TX and 1 GbE Ethernet systems. A variety of P-Jack modules snap in or out of each patch panel. These include UTP and STP twisted-pair and fiber optic active P-Jacks. The same variety of A-Jacks are available. This embodiment facilitates the upgrading of horizontal cabling of a network by simply upgrading the active jacks and the horizontal cables.

Patch panels according to the present invention may also be used to hold passive "non-active" twisted pair communication jacks as shown by the exploded view of patch panel 23 of FIG. 1. The non-active jacks 24 and a motherboard 26 holding contact carriers 28 are assembled together using inserts 30. In the "non-active" communication jack embodiment shown in FIG. 1, the motherboard 26 and the contact carriers 28 are configured to provide only power to the jacks 24, rather than both power and data as in "active" communication jack embodiment. Patch panels according to this invention may be used to provide power to PDs in deployments that utilize unused signal pairs to transmit power. In one embodiment, the motherboard provides electrical power to a network powered device via the modular jack over a pair of network cable conductors. Covers 32 are provided for protecting the motherboard 26 and the contact carriers 28, and a frame 34 is provided to hold and protect the entire patch panel assembly.

Figure 2:
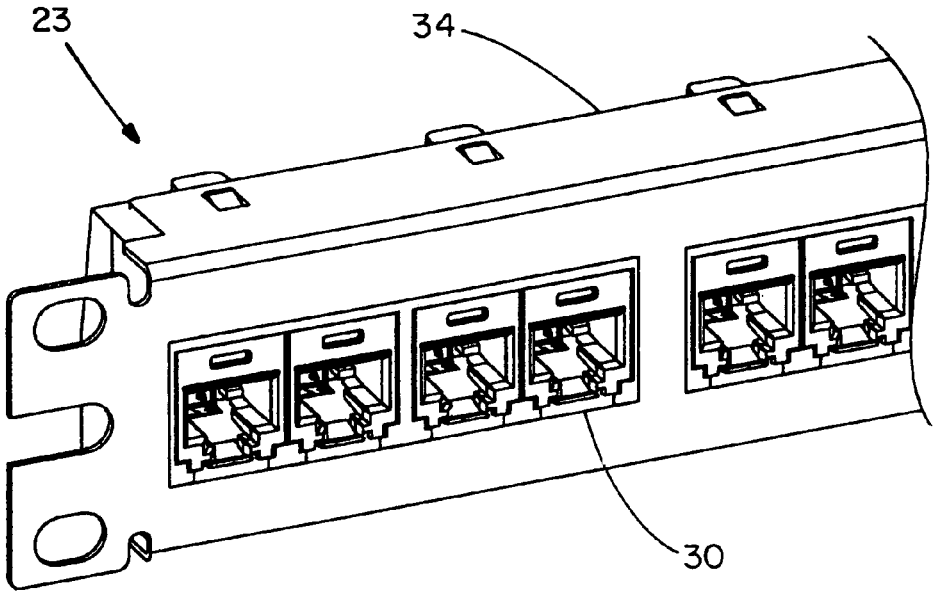
FIG. 2 is a perspective view of a portion of a patch panel.

FIG. 2 shows a perspective view of a segment of the patch panel 23 of FIG. 2, with the frame 34 overlapping and covering the inserts 30. A front view of the patch panel 23 is shown in FIG. 3, showing the jacks 24 housed within the frame 34.

Figure 3:
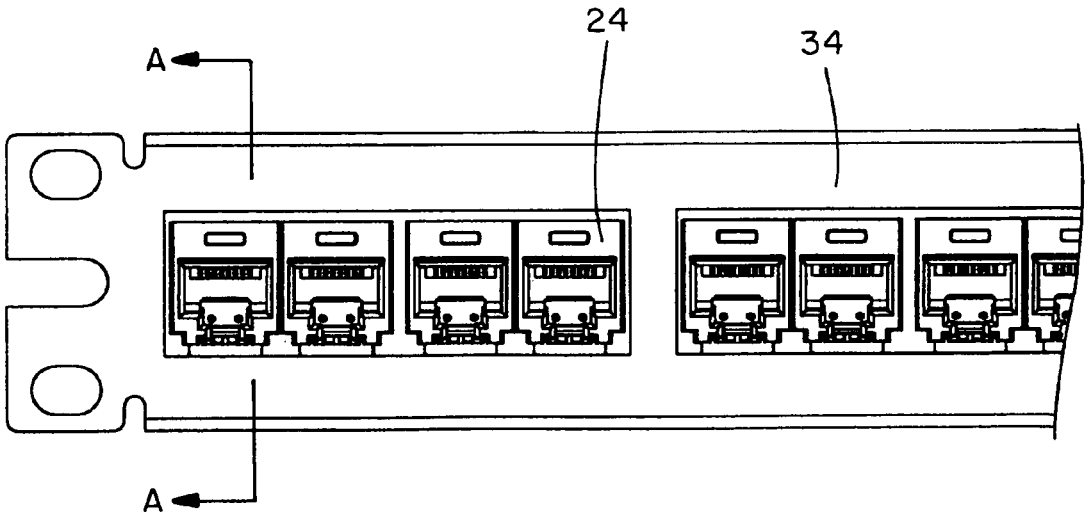
FIG. 3 is a front view of a portion of a patch panel.
Figure 4:
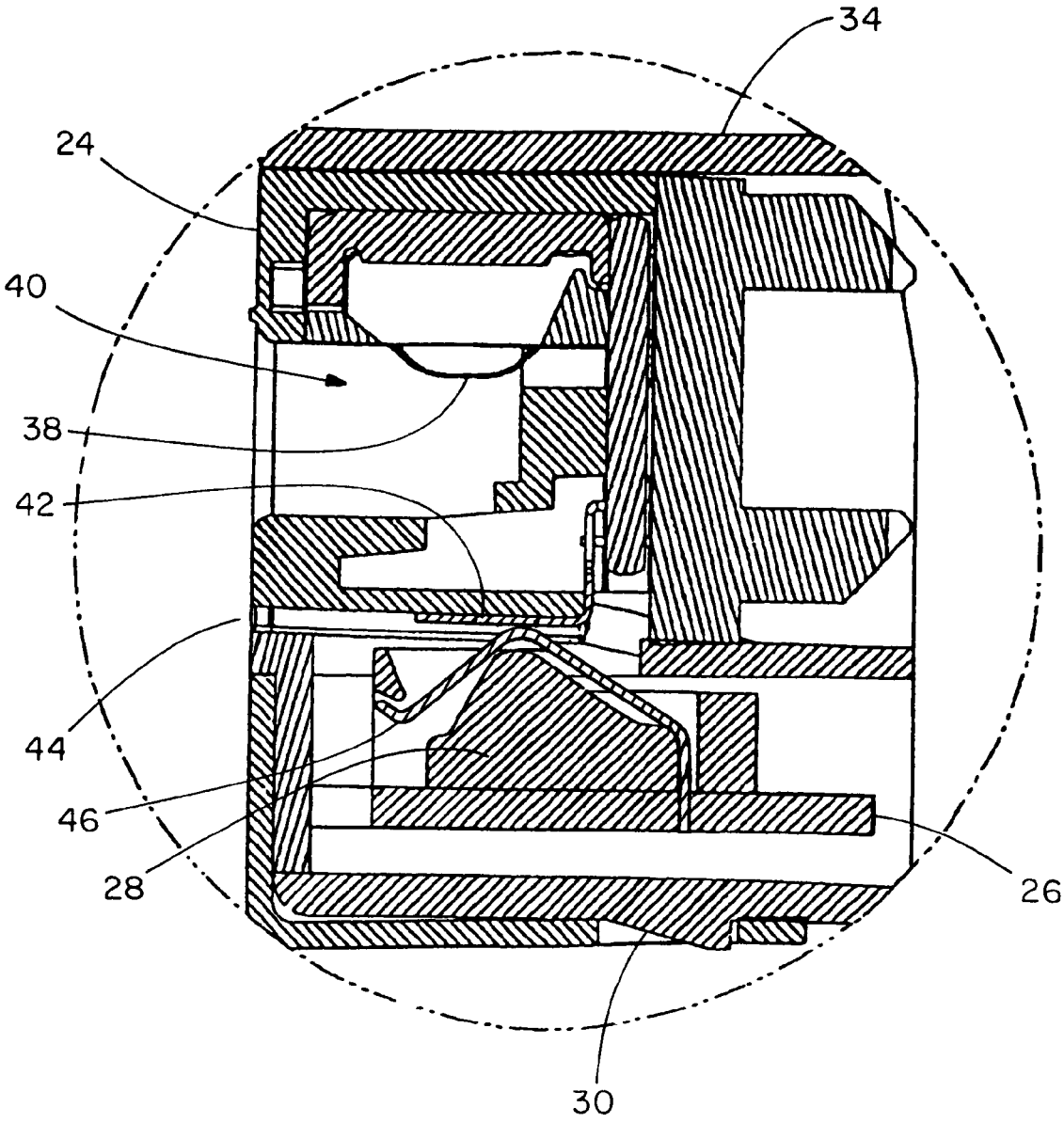
FIG. 4 is a cross-sectional view along the line A—A of FIG. 3.

FIG. 4 is a cross-sectional view along the line A—A of FIG. 3 showing a jack 24 within a frame 34. An insert 30 holds a printed circuit board (PCB) of the motherboard 26, upon which a contact carrier 28 is mounted. Data contacts 38 of the jack 24 extend into an outlet 40 of the jack 24. Jack power contacts 42 are seated beneath the outlet 40, and reside within a power contact channel 44. Power is provided to the jack power contacts 42 via contact carrier power contacts 46. When the patch panel is assembled as shown in FIG. 4, the contact carrier power contacts 46 are biased against the jack power contacts 42 due to spring tension within the contact carrier power contacts 46. In the embodiment shown in FIG. 4, there are two jack power contacts 42 and two contact carrier power contacts 46, and the motherboard 26 is adapted to supply power to the jack power contacts 42 of the jack 24 without the need for additional contacts between the jack 24 and the motherboard 26.

Figure 5A:
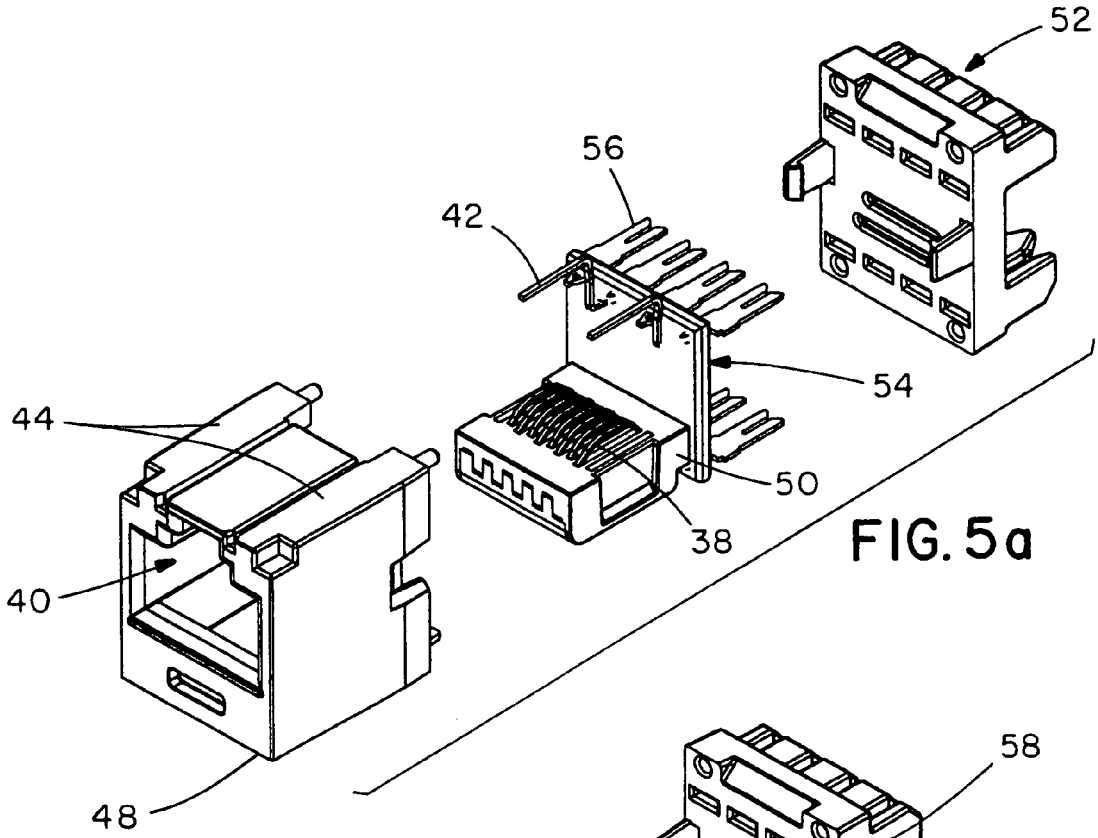
FIGS. 5*a*, 5*b* and 5*c* are perspective views showing the assembly of a communications jack.
Figure 5B:
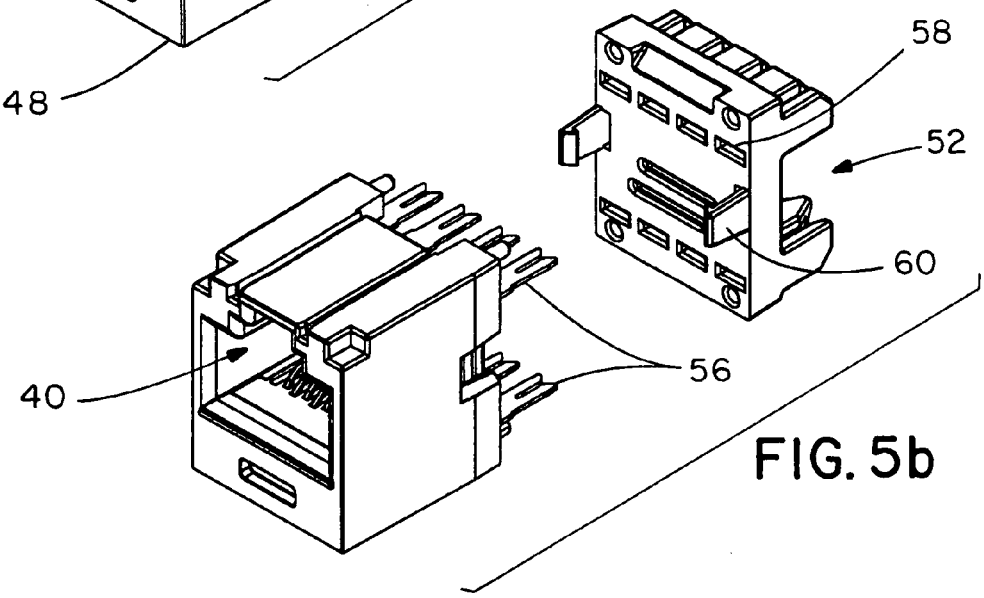
Figure 5C:
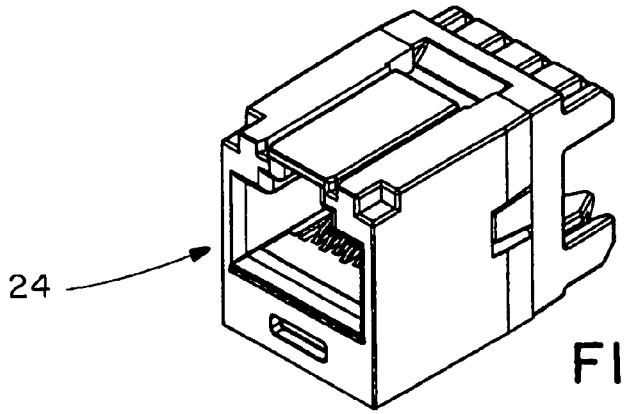

Turning now to FIGS. 5*a*, 5*b*, and 5*c*, the assembly of a punch-down type jack 24 according to one embodiment of the present invention is shown in a step-by-step process. The jack 24 may be assembled from three pieces: an outer jack housing 48, a contact module 50, and an insulation displacement connector (IDC)/punch-down connector 52. The contact module 50 contains a jack PCB 54 that is connected to the data contacts 38 and IDCs 56. The jack power contacts 42 are also connected to the jack PCB 54.

To assemble the jack 24, the outer jack housing 48 and the contact module 50 are joined together as shown in FIG. 5*b*. In this step, the jack power contacts 42 are inserted into the power contact channels 44, and the data contacts 38 are positioned within the outlet 40. Next, IDC slots 58 of the IDC/punch-down connector 52 are aligned with the IDCs 56, and assembly tabs 60 of the IDC/punch down connector 52 are attached to the outer jack housing 48 to form an assembled jack 24 as shown in FIG. 5*c*.

Figure 6:
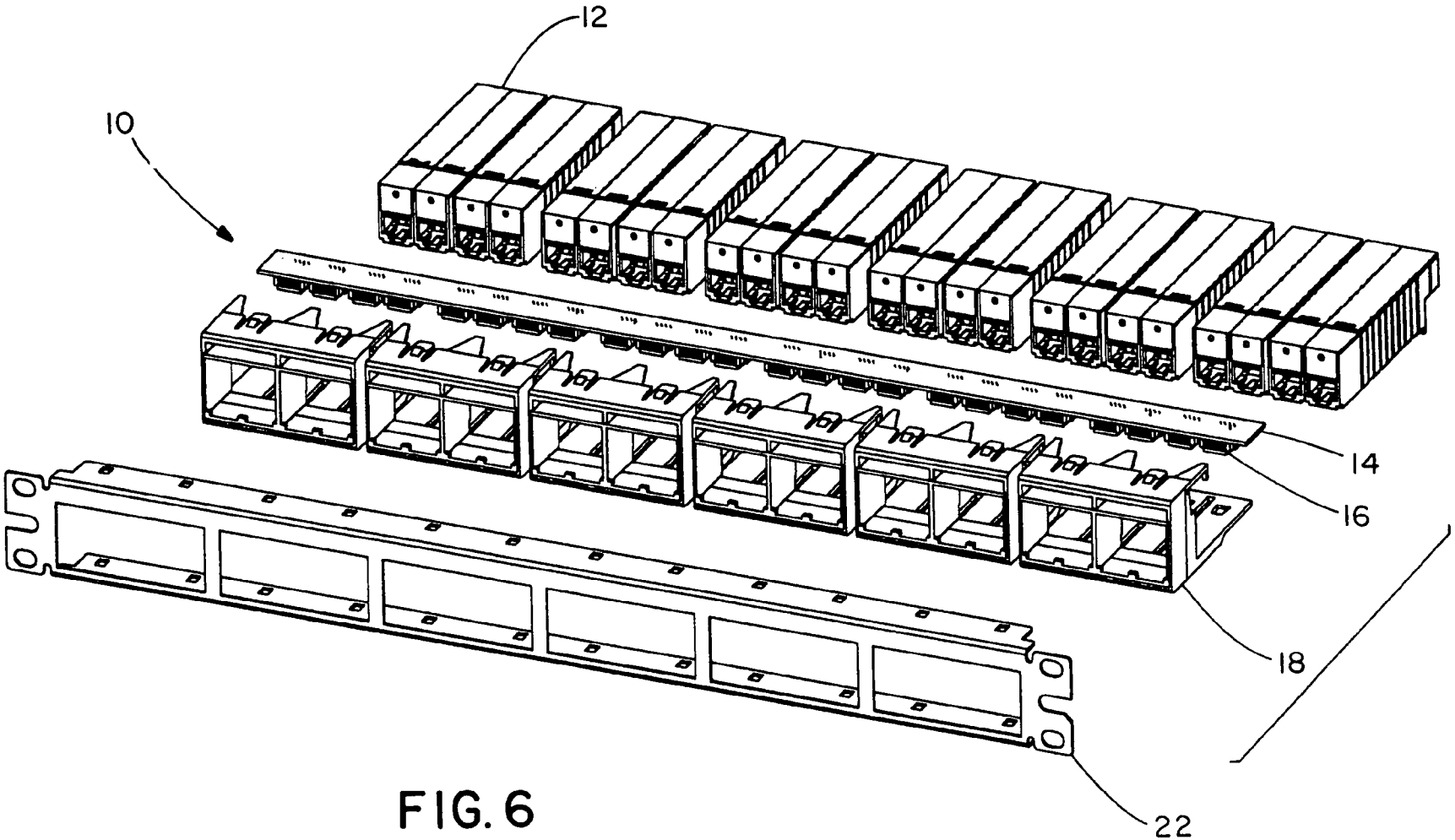
FIG. 6 is an exploded view of a patch panel.

Turning now to FIG. 6, a patch panel 10 is shown in an exploded view. The patch panel 10 has a number of active P-jacks 12 adapted to communicate with a motherboard 14 having a number of contact carriers 16. Patch panels according to the present invention may be used to provide power to devices in deployments such as power-over-Ethernet (PoE) deployments. In one such deployment, the motherboard in the patch panel provides electrical power to a network powered device via one of the active P-jacks over a pair of network cable conductors (in other embodiments, the motherboard provides electrical power to a network powered device via one of the A-jack over a pair of network cable conductors). In the embodiment of FIG. 6, one contact carrier is provided for each of the active jacks 12. The active jacks 12 and the motherboard 14 are held in place using inserts 18. In the embodiment shown in FIG. 6, each of the inserts 18 is adapted to hold four active jacks 12. A frame 22 is provided for mounting and protecting the other components of the patch panel 10. Active jacks used with the present invention may be active jacks of the type shown and described in co-pending U.S. patent application Ser. No. 10/439,716, entitled "Systems and Methods for Managing a Network," filed on May 16, 2003, and incorporated herein by reference in its entirety.

Figure 7:
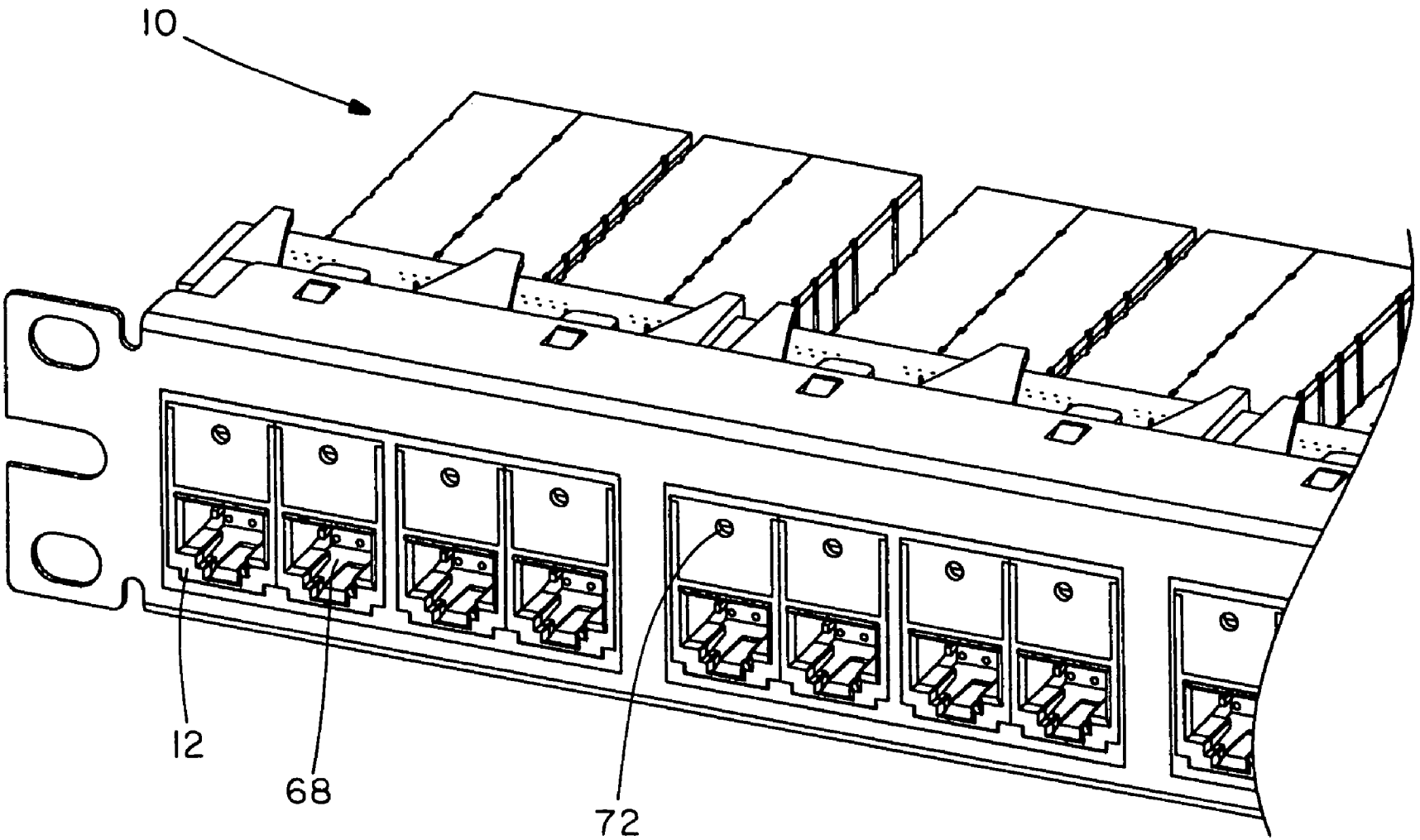
FIG. 7 is a perspective view of a portion of a patch panel.
Figure 8:
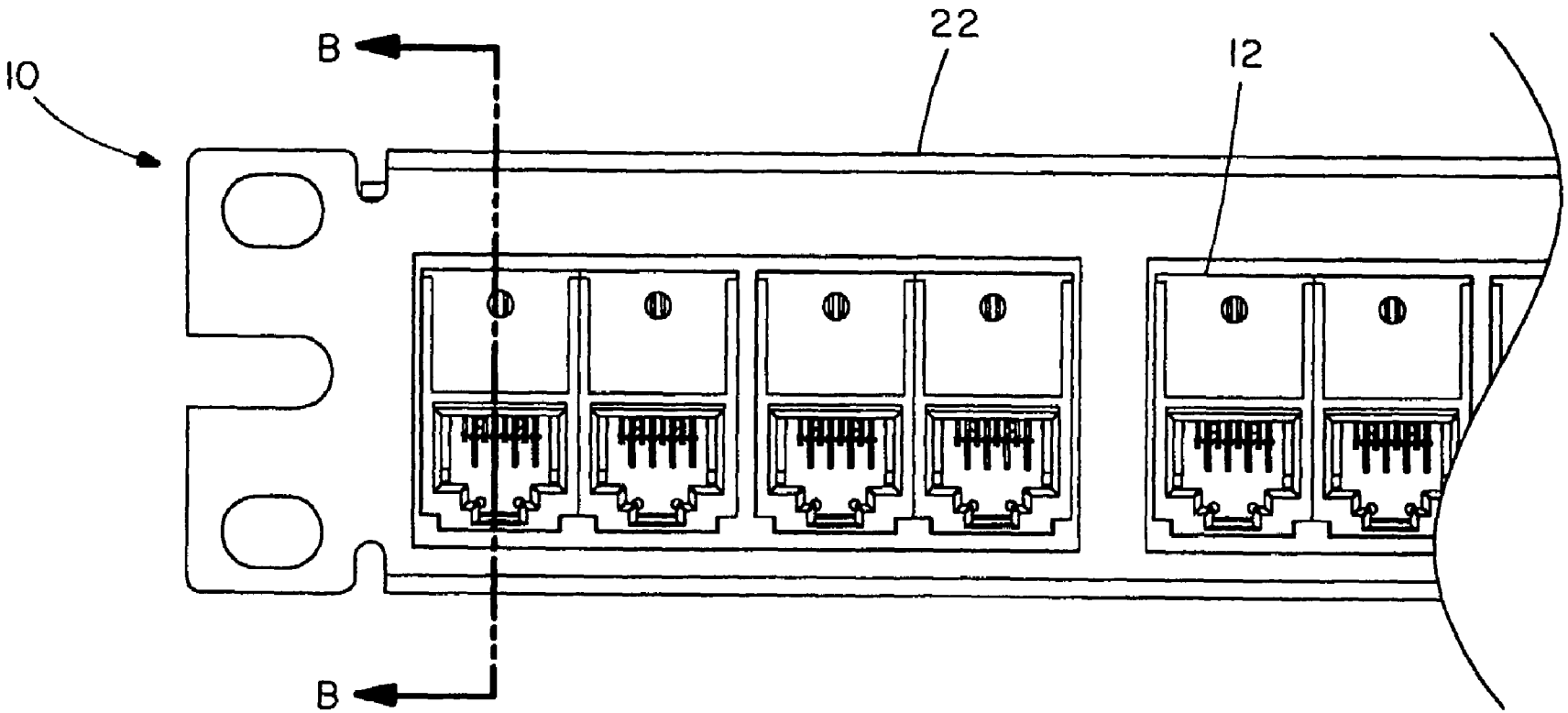
FIG. 8 is a front view of a portion of a patch panel.
Figure 9:
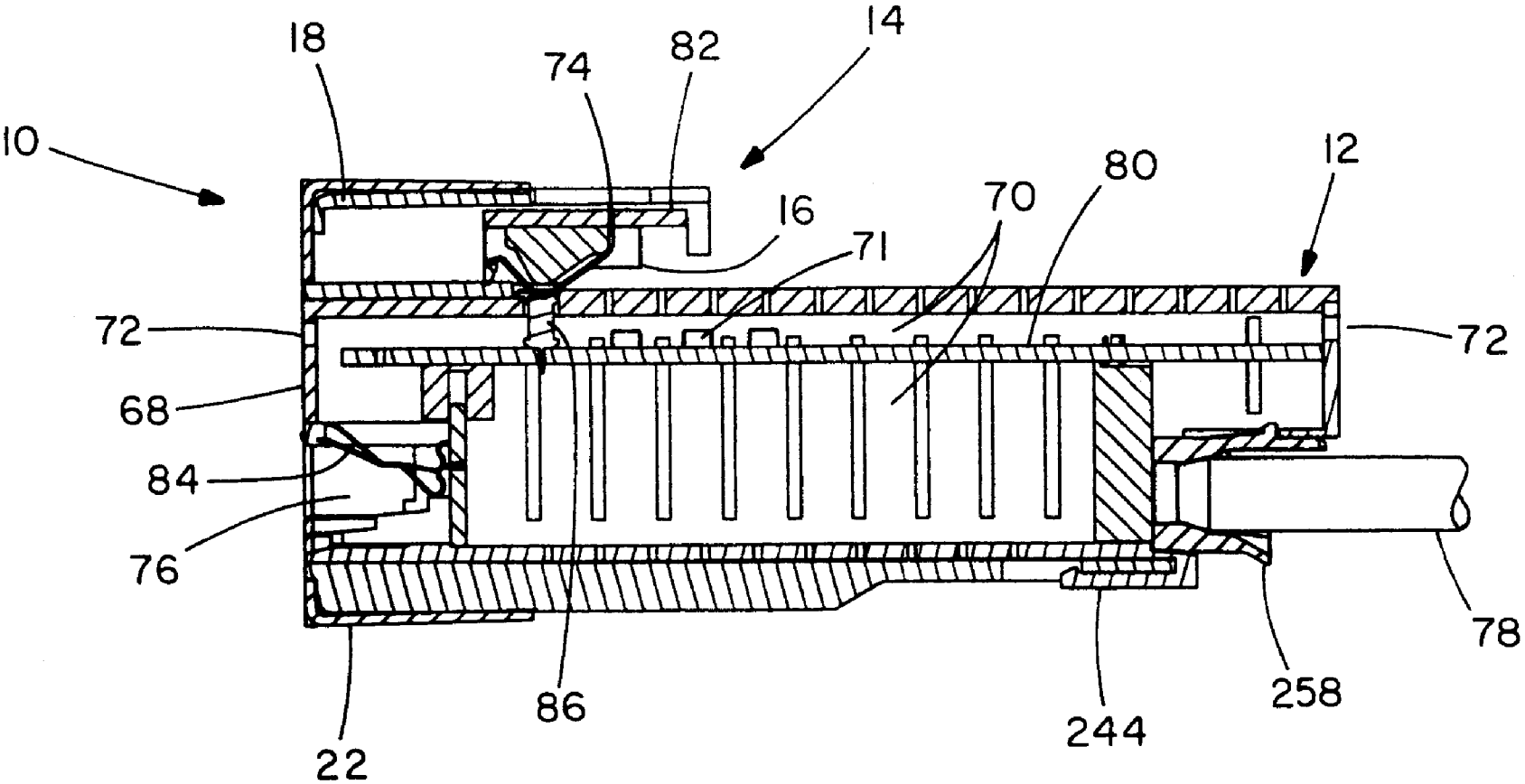
FIG. 9 is a cross-sectional view along the line B—B of FIG. 8.

Turning now to FIG. 7, a patch panel assembly 10 populated with active jacks 12 is shown. The active jacks 12 of the embodiment shown in FIG. 7 comprise a connector port 68 for holding a communications plug and space on a PCB for holding common electronic components of the active jacks 12. According to one embodiment, the connector port 68 is an RJ-45 port. Indicator lights 72 are provided on the front and rear of the active jacks 12 for providing cable revision and installation signals to a network revisor or installer. According to some embodiments, from two to ten active jack motherboard contacts 74 (as shown in FIG. 9) are provided. FIG. 8 is a front view of the patch panel 10 of FIG. 7, showing the active jacks 12 seated within the frame 22. One example of management-and-power assignments for an eight-pin embodiment is:

Pin 1: 48 V Power
Pin 2: −48 V Return
Pin 3: Ground
Pin 4: 3.3 V Power
Pin 5: Read/Write
Pin 6: Data
Pin 7: Clock
Pin 8: Reset.

According to other embodiments it is desirable to separate pins assigned for power to the outermost pins, with reassignment of the other pins as necessary.

Turning now to FIG. 9, a cross-sectional view of the line B—B of FIG. 8 is shown. The frame 22 holds the insert 18, which in turn holds the active jack 12. The active jack 12 includes an outlet 76 for accepting a communications plug. A communications cable 78 is connected to the active jack 12 by means of a termination cap 258. An active jack PCB 80 contains electronics necessary for individual active jacks, while electronics common to all active jacks within a patch panel are provided on a motherboard PCB 82. Data contacts 84 extend into the outlet 76.

Figure 15:
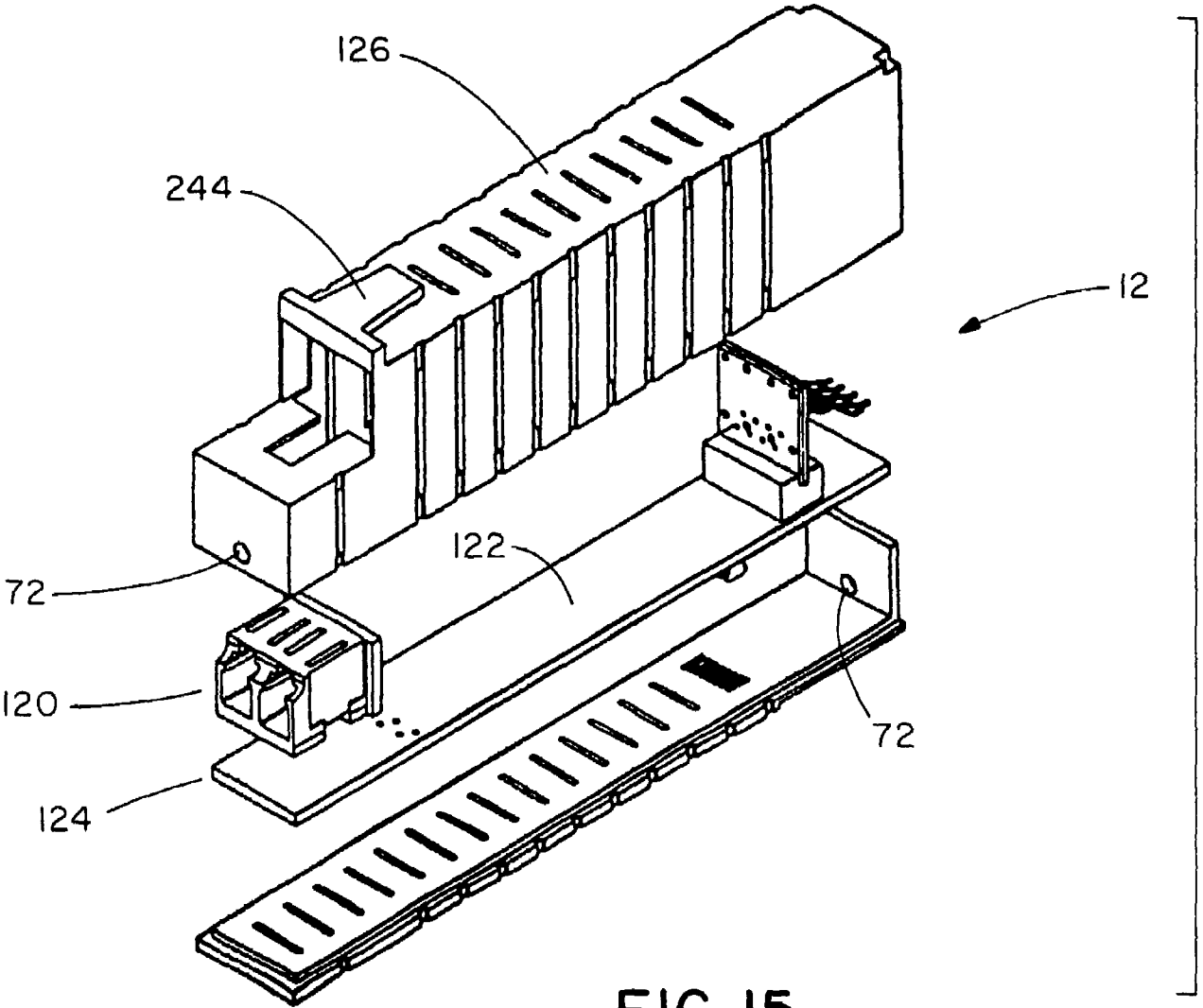
FIG. 15 is an exploded view of a copper-to-fiber optic active jack.
Figure 16:
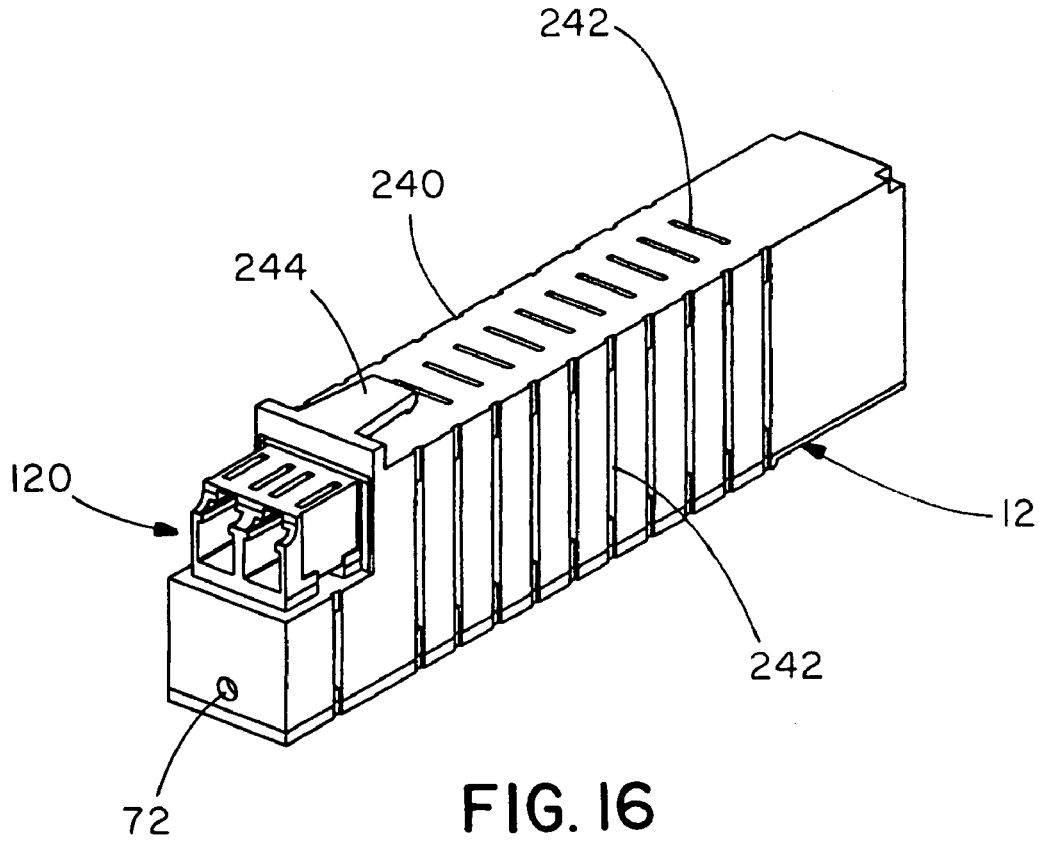
FIG. 16 is a perspective view of a fiber optic active jack.
Figure 17:
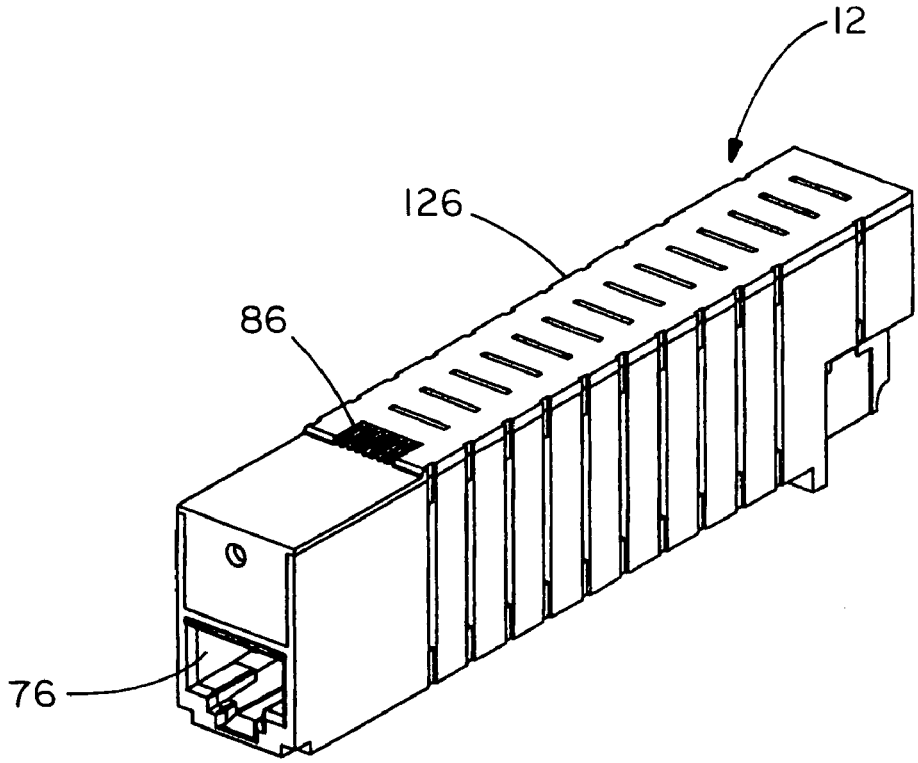
FIG. 17 is a perspective view of a fiber optic active jack.
Figure 47:
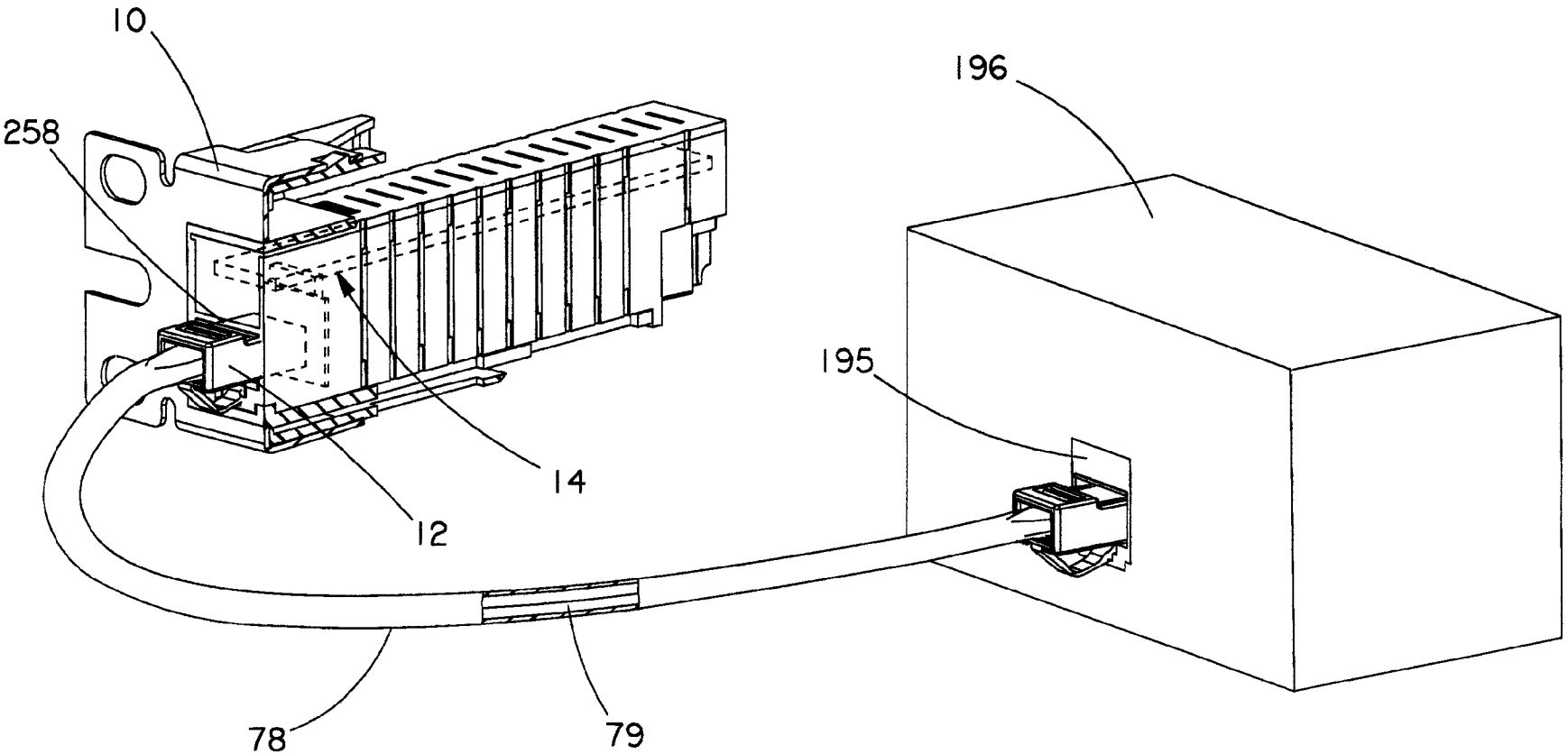
FIG. 47 is a schematic drawing showing a communication system in which power is provided to a network powered device via a jack.

The electronics area 70 may hold common electronic components necessary for each active jack 12. The motherboard 14 is shown in FIG. 9, with the motherboard PCB 82 holding a contact carrier 16. Motherboard contacts 74 are biased against active jack PCB contacts 86 via spring tension within the motherboard contacts 74. The active jack PCB contacts 86 extend downwardly from the active jack PCB and route electronic signals and power to and from the electronic components 71 resident on the active jack PCB 80. The motherboard 14 may be connected to an individual power supply for each patch panel 10 and route power to each jack on the patch panel that requires power. The embodiments of FIG. 9 may be used with fiber optic active jacks as shown in FIGS. 15–17. As shown in FIG. 47, when a communications cable 78 is connected between the active jack 12 of the patch panel 10 and the jack 195 of a network powered device 196, the motherboard 14 provides electrical power to the network powered device 196 via the jack 12 over a pair of network cable conductors 79 of the communications cable 78.

Figure 10:
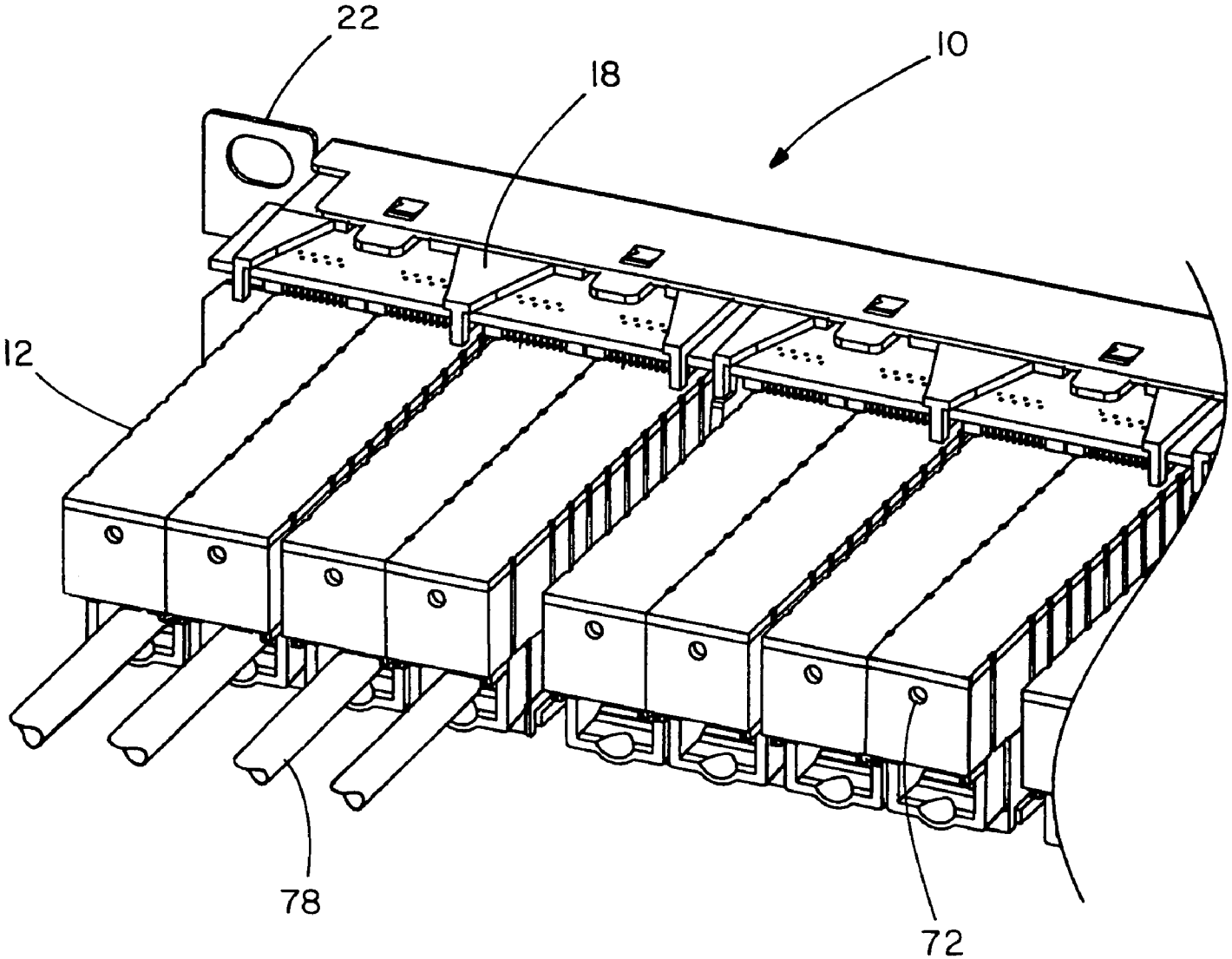
FIG. 10 is a rear perspective view of a portion of a patch panel.

A rear view of patch panel 10 is shown in FIG. 10 with communications cables 78 connected to the active jacks 12. In an alternative embodiment, active jacks 12 may be installed into the inserts 18 without cables attached, and the cables may be attached following installation. Indicator lights 72 can also be seen at the rear of active jack 12 in FIG. 10, providing cable revision and installation signals to a network revisor or installer.

Figures 11, 12:
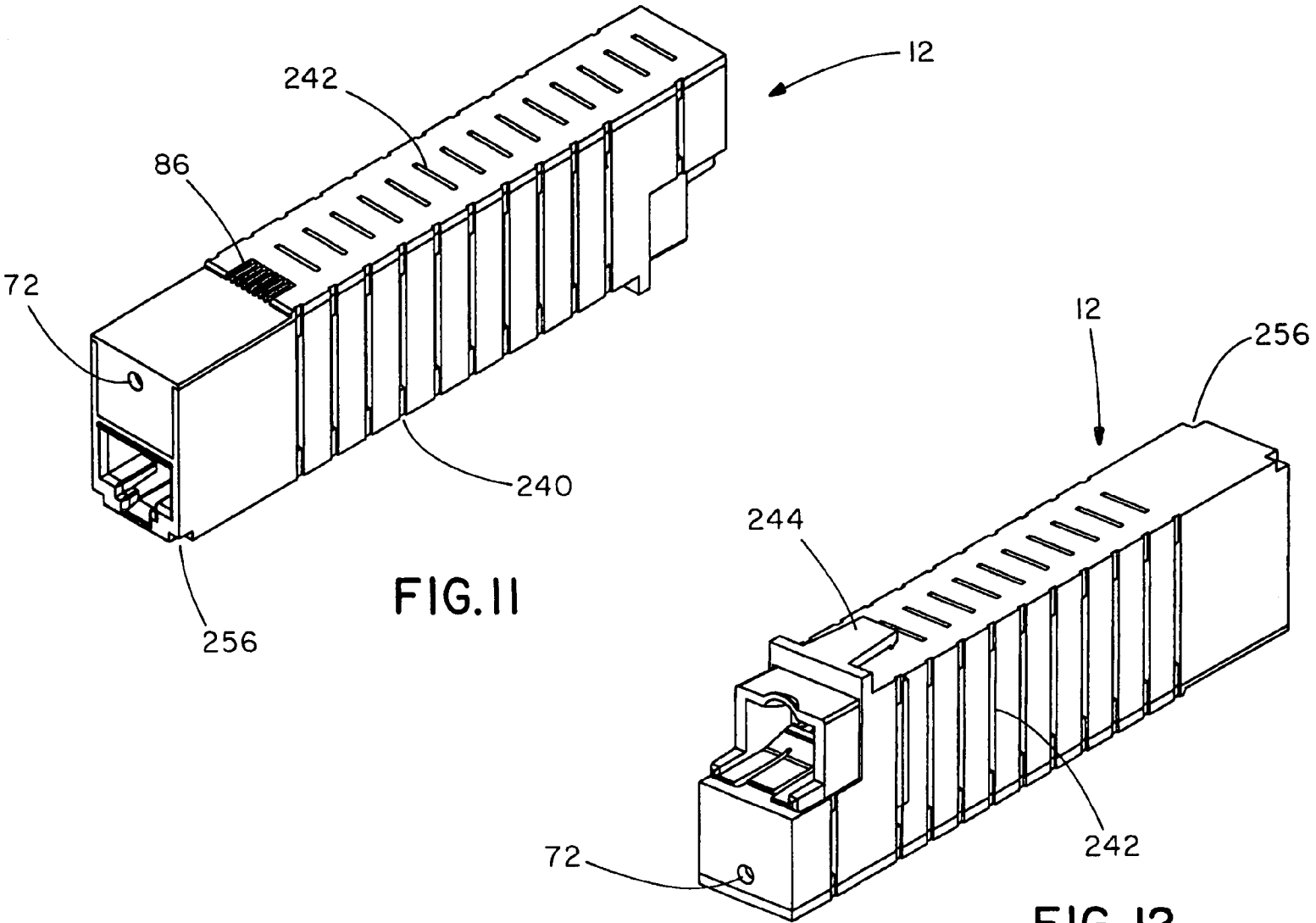
FIG. 11 is a perspective view of an active jack.
FIG. 12 is a perspective view of an active jack.

FIGS. 11 and 12 show an assembled active jack 12. An indicator light 72 is present at both ends. Active jack PCB contacts 86 are open to air. Notches 240 and slots 242 in the active jack 12 provide a means to exchange warmer air inside the jack 12 housing with cooler surrounding air. FIG. 12 shows a latch feature 244 to hold the active jack 12 in the insert 18.

Figure 13:
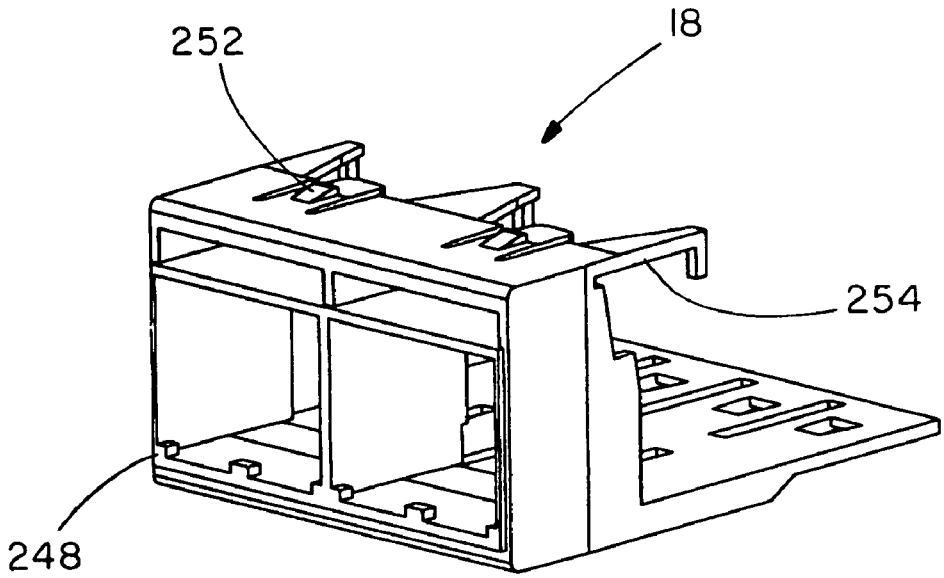
FIG. 13 is a perspective view of a patch panel insert.
Figure 14:
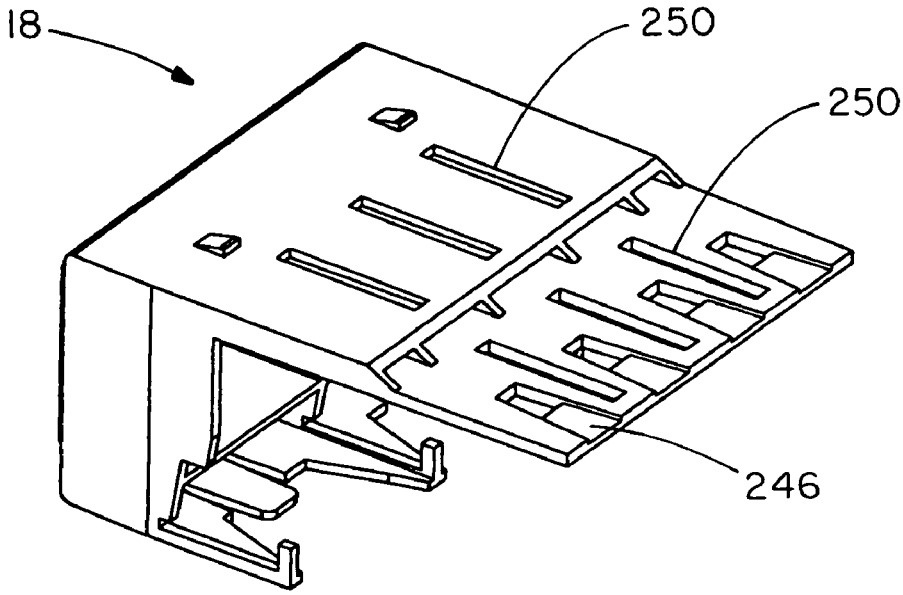
FIG. 14 is a perspective view of a patch panel insert.

FIGS. 13 and 14 show an insert 18 for mounting active jacks 12. A latch feature 244 on the active jack 12 mates with receptacle feature 246 on insert 18. Front stops 248 align with recesses 256 on the front face of active jack 12. Cooling slots 250 in the insert 18 aid in the exchange of warmed air. Latch features 252 hold insert the 18 in the frame 22. A support arm 254 mounts the motherboard assembly 14.

Systems and methods according to the present invention may be utilized in connection with a number of types of jacks and may facilitate communications processes in a variety of communications environments. For example, as shown in FIGS. 15–17, a fiber optic active jack may be provided for use with patch panels according to the present invention. In this embodiment an SFF duplex fiber optic plug receptacle 120 is provided with media converter and/or transceiver electronics mounted in an electronics mounting area 122 on a fiber optic jack PCB 124. While the electronics mounting area 122 has been shown on the top of the fiber optic jack PCB 124, it is to be understood that electronic components may alternatively or additionally be mounted on the underside of the PCB 124. In the embodiment shown in FIGS. 16 and 17, an electronics cover 126 is shown covering the electronics components.

Figure 18:
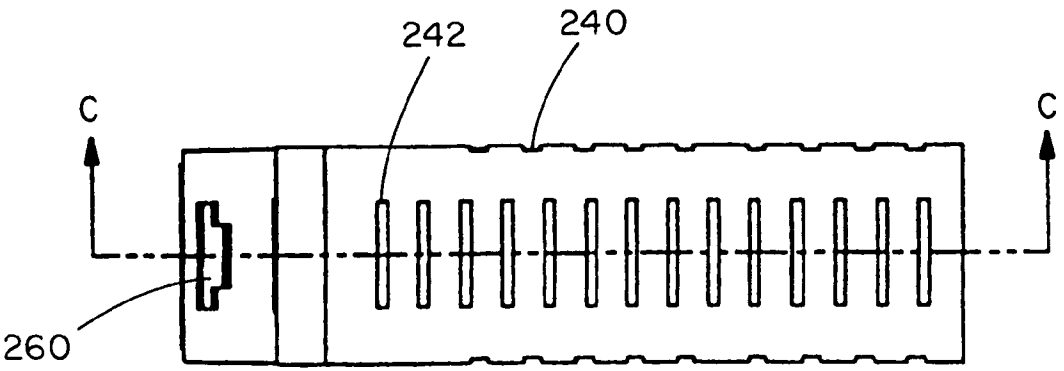
FIG. 18 is a plan view of an active jack for wall plate mounting.
Figure 19:
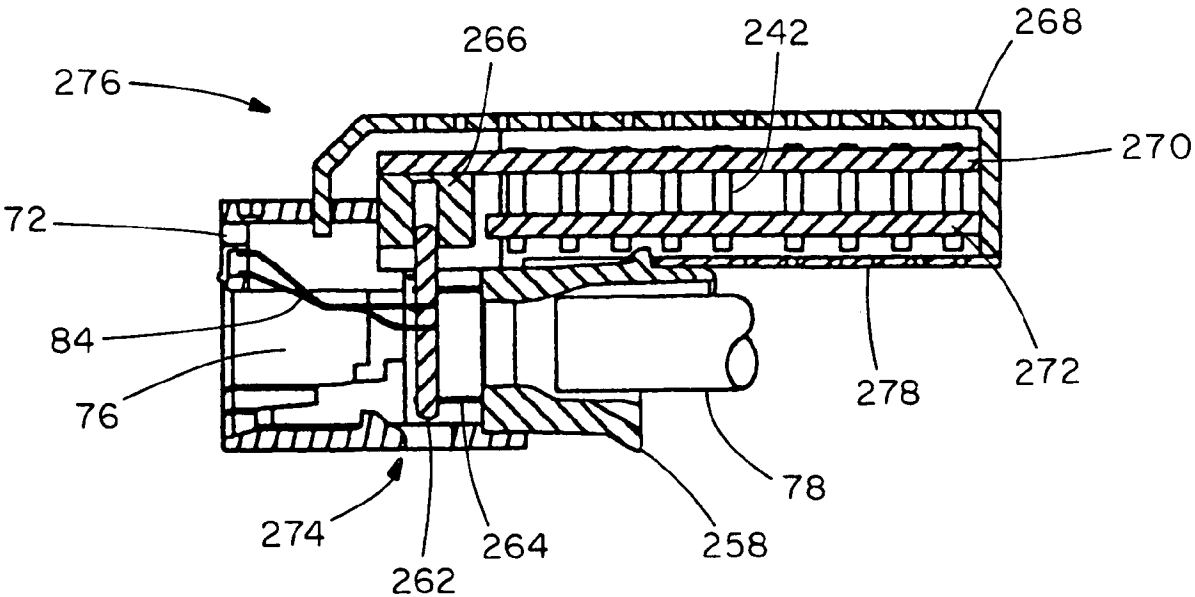
FIG. 19 is a cross-sectional view along the line C—C of FIG. 18.

FIGS. 18 and 19 show an active A-jack 276 for use in wall plates. FIG. 18 shows cooling notches 240 and slots 242. Mounting features 260 and 274 provide means to retain this active jack in a wall plate. FIG. 19 is a cross-sectional view of an active jack 276 along the line C—C of FIG. 18. Housings 268 and 278 enclose two secondary PCB's 270 and 272. An outlet 76 is provided with contacts 84 to mate to a telecommunications plug, (e.g., an RJ-45 plug). Contacts 84 are inserted into a first PCB 262. This PCB makes electrical contact to the secondary PCB 270 through a connector 266. Secondary PCB's 270 and 272 are connected electrically to each other as well.

A communications cable 78 is connected to the active jack 276 through a termination cap 258, an IDC connection 264, and the primary PCB 262. Wall plate jacks require the indicator light 72 on the front face only.

Figure 21:
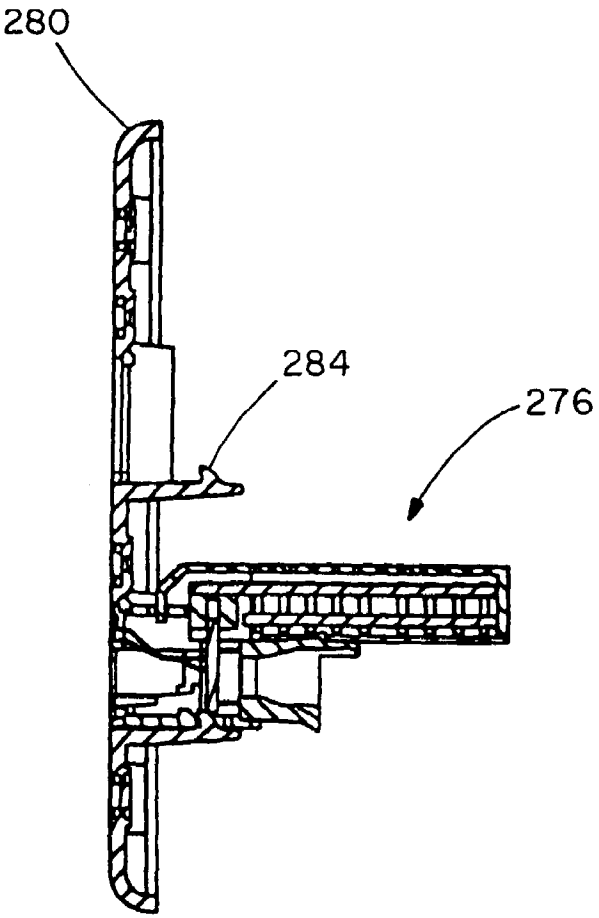
FIG. 21 is a cross-sectional view along the line D—D of FIG. 20.
Figure 20:
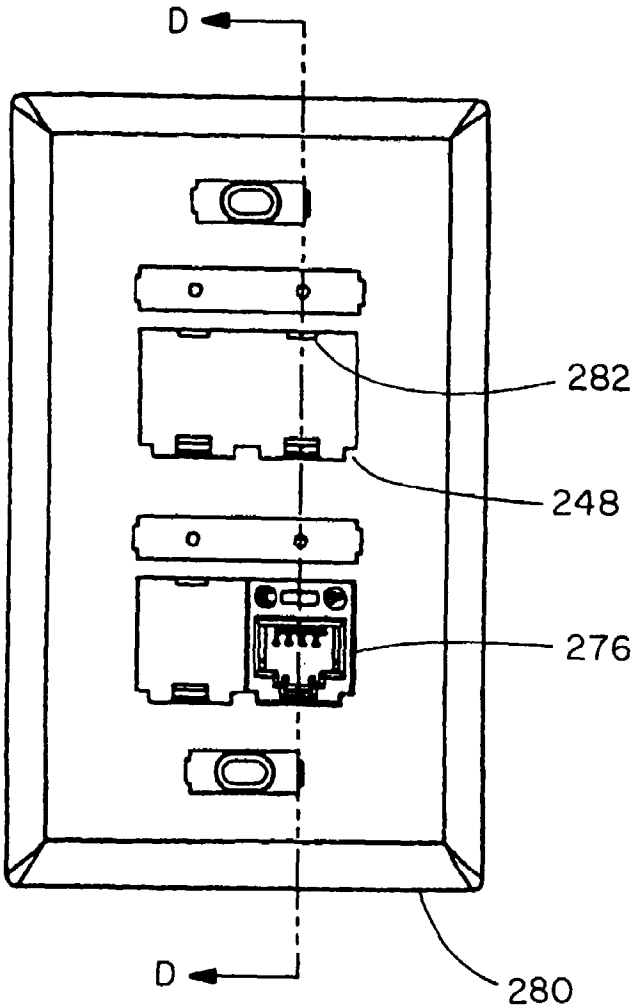
FIG. 20 is a front view of a wall plate with an active jack installed.

FIGS. 20 and 21 show the typical use of the wall plate active jack 276. FIG. 20 is a typical wall plate 280 with a four positions. Latching features 262 and 264 and front stop 248 retain the active jack 276 in the wall plate 280.

Figure 22:
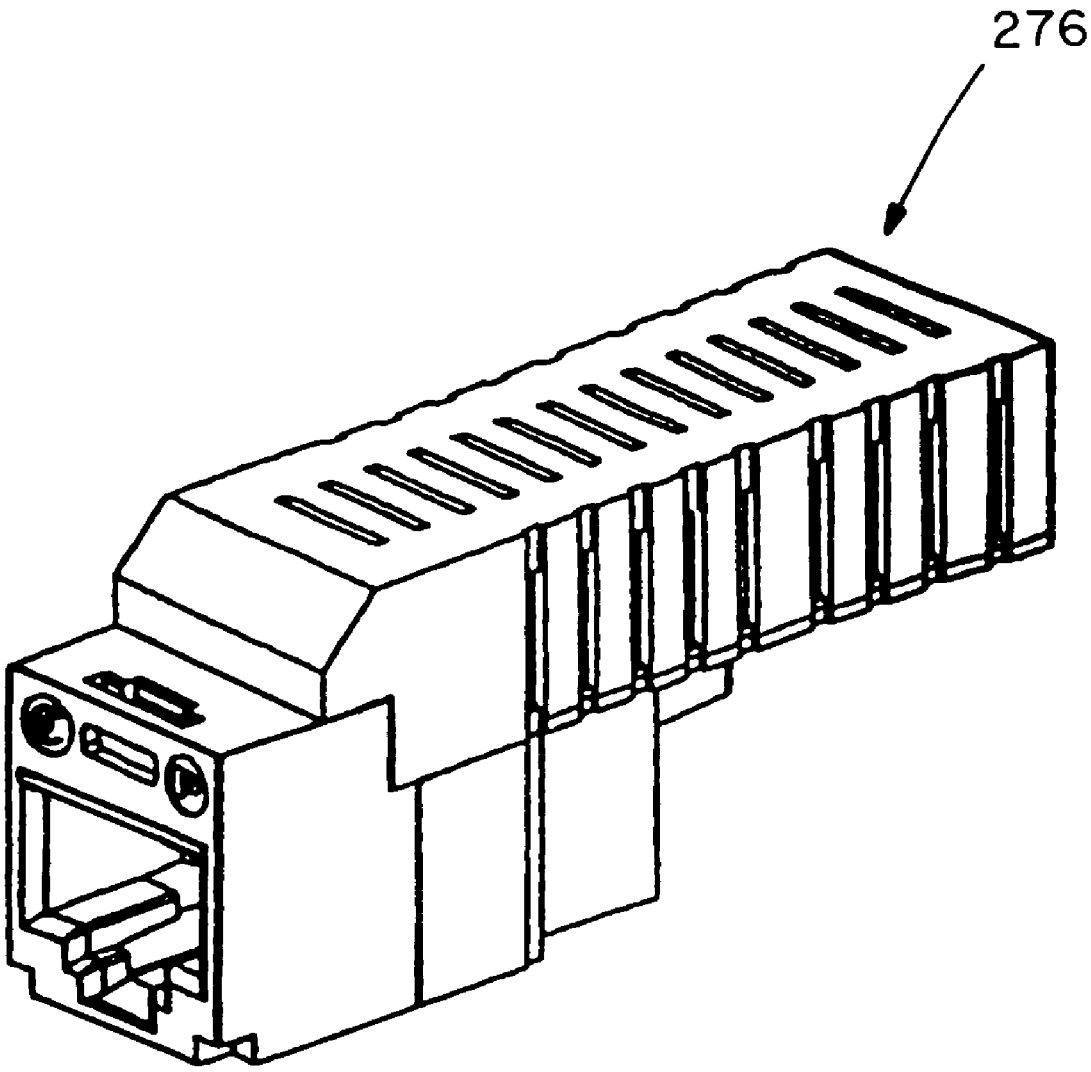
FIG. 22 is a perspective view of an active jack for wall plate mounting.
Figure 23:
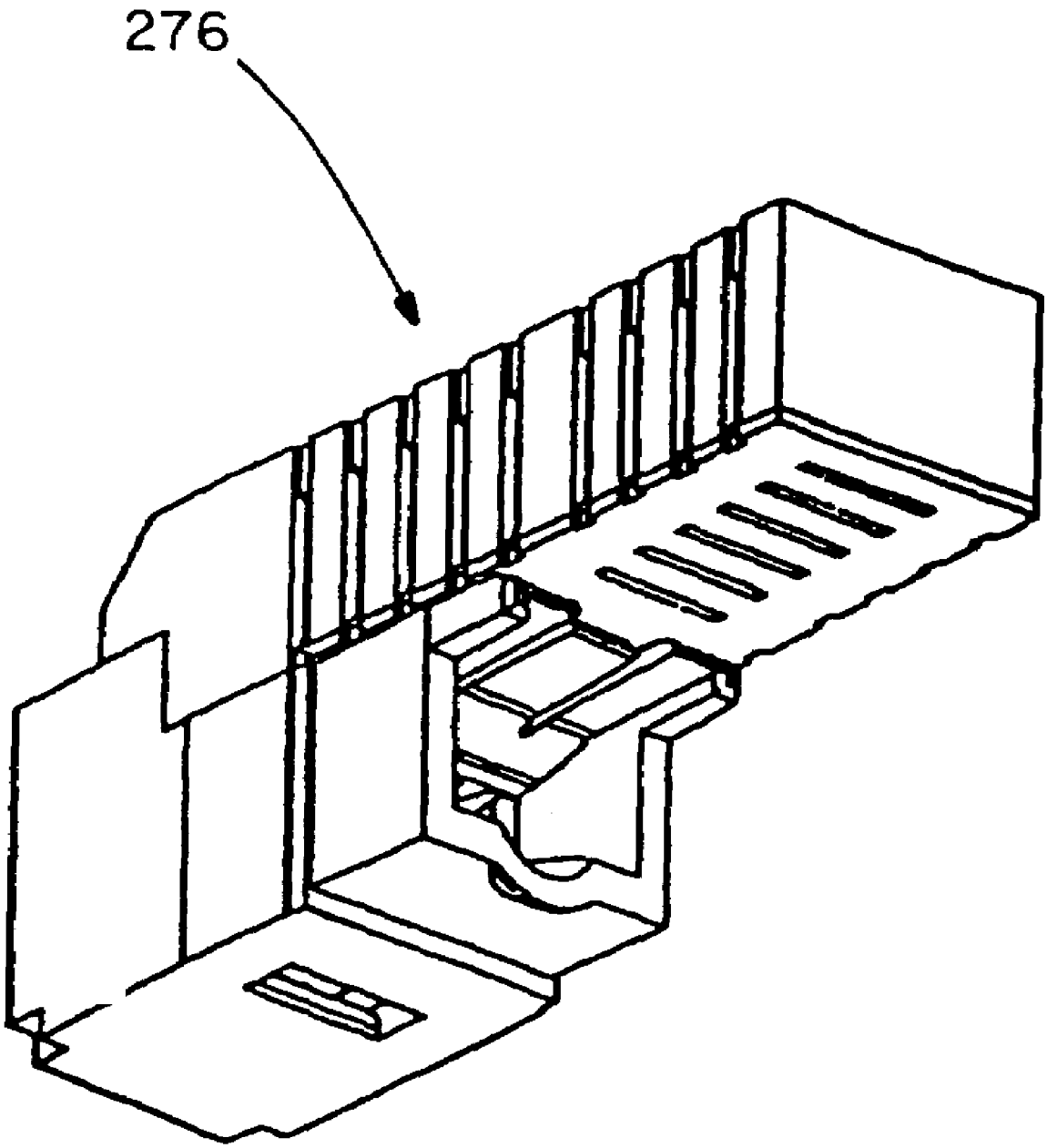
FIG. 23 is a perspective view of an active jack for wall plate mounting.

FIGS. 22 and 23 show an assembled twisted pair active jack 276.

Figure 24:
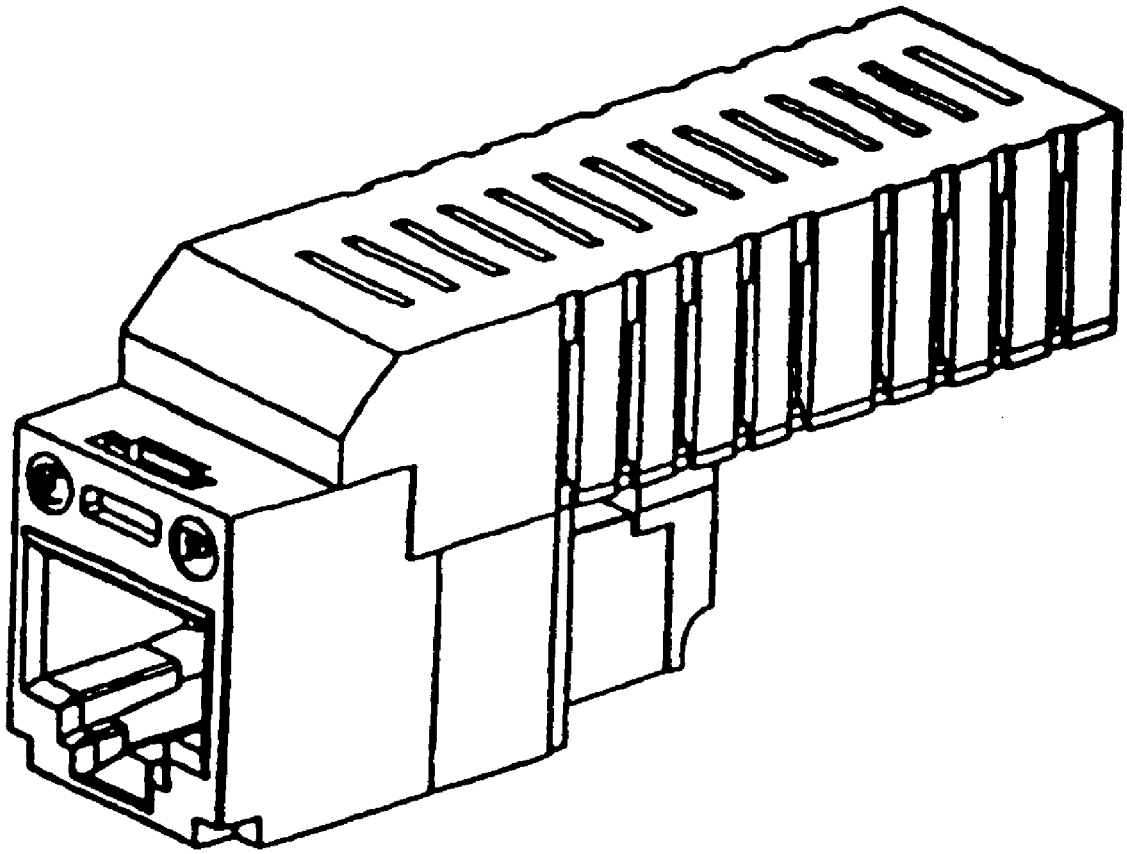
FIG. 24 is a perspective view of a fiber optic active jack for wall plate mounting.
Figure 25:
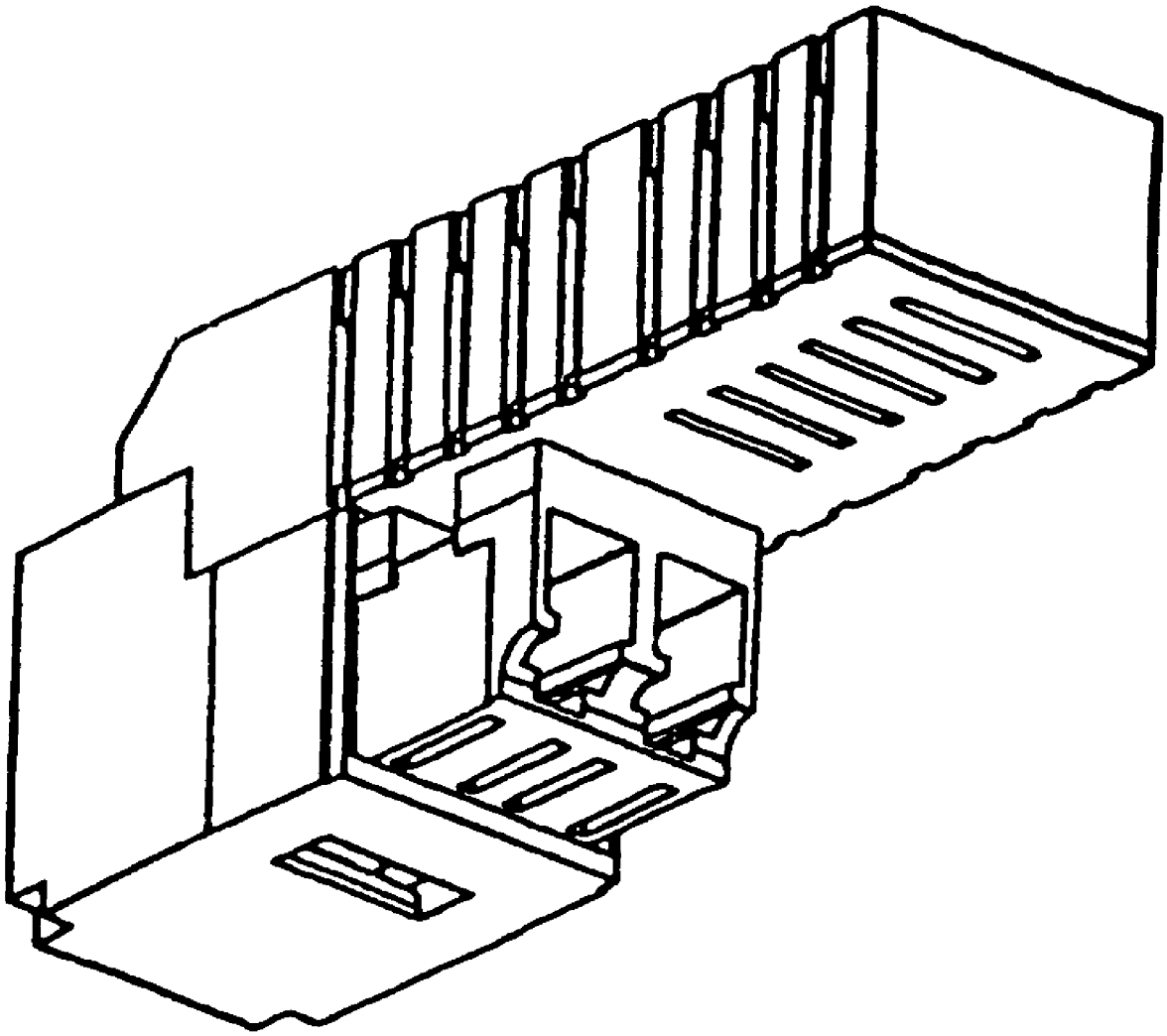
FIG. 25 is a perspective view of a fiber optic active jack for wall plate mounting.

FIGS. 24 and 25 show an assembled fiber optic active jack.

Figure 26:
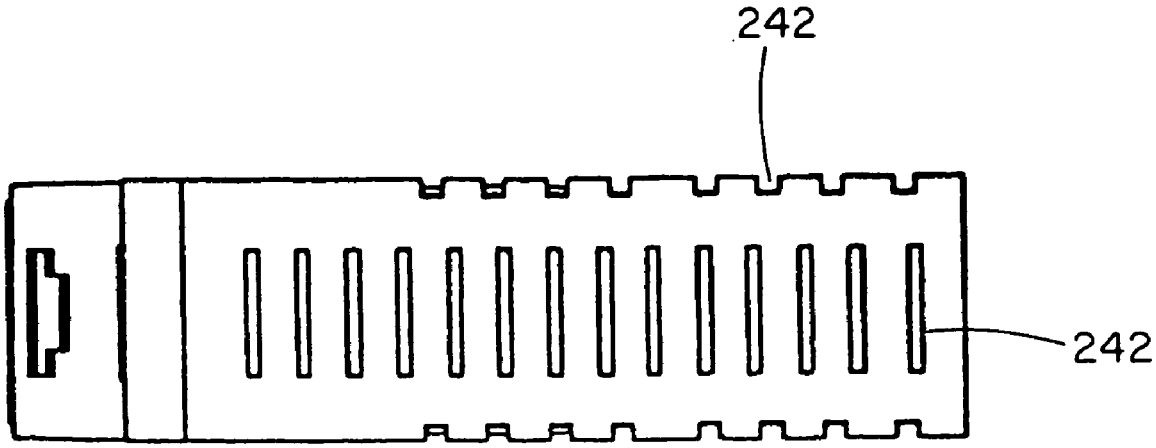
FIG. 26 is a plan view of an alternate construction of an active jack for wall plate mounting.
Figure 27:
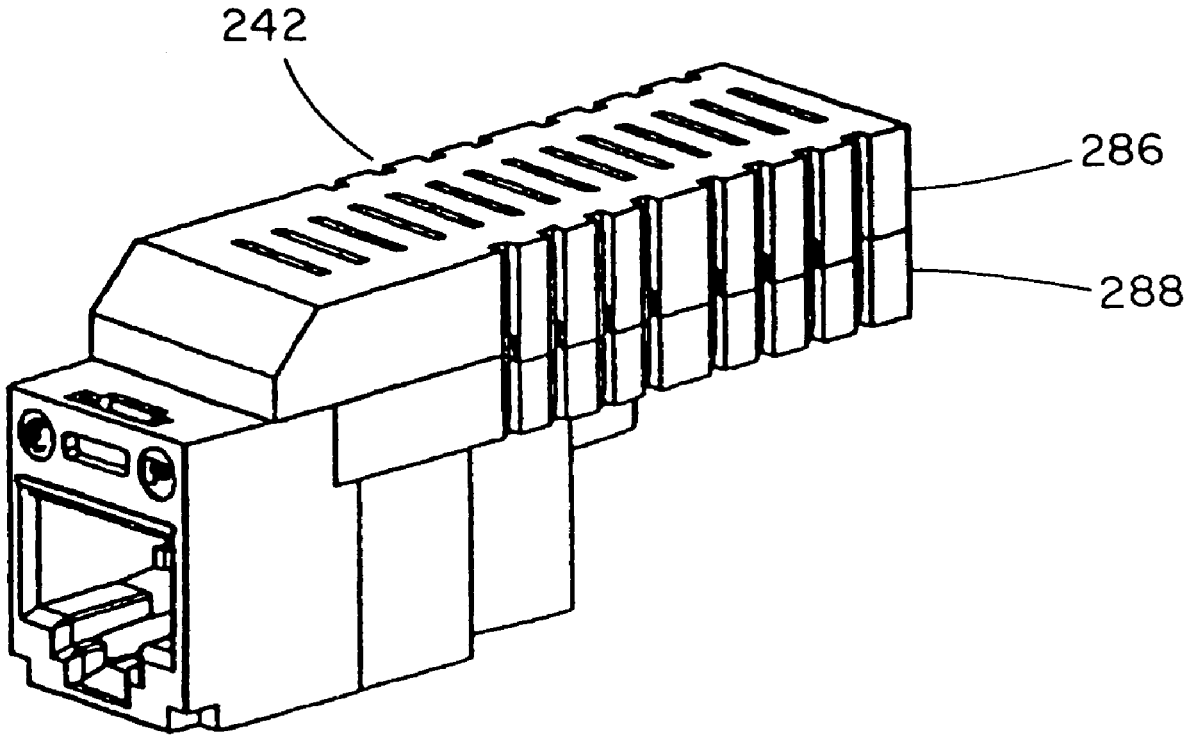
FIG. 27 is a perspective view of an alternate construction of an active jack for wall plate mounting.
Figure 28:
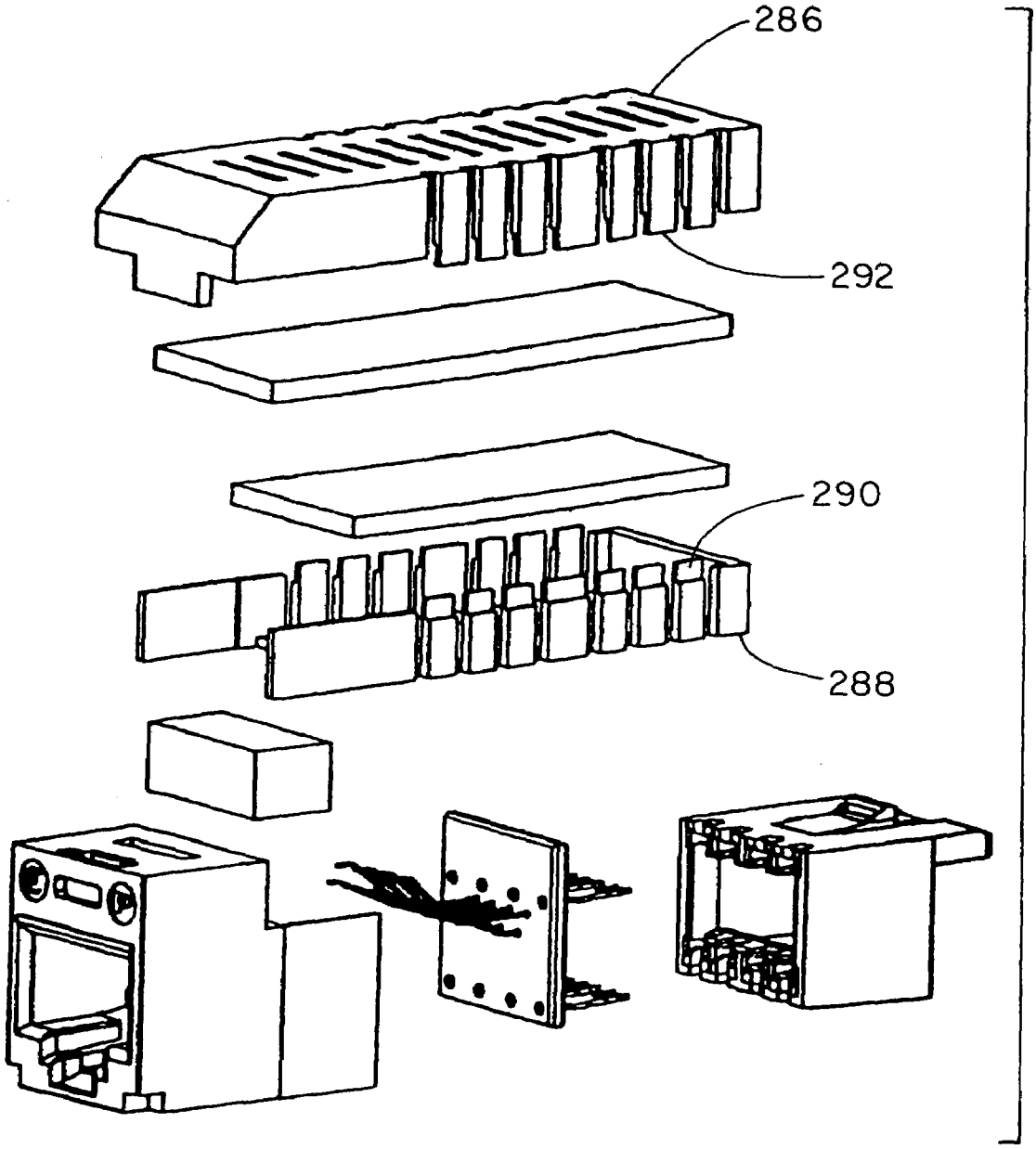
FIG. 28 is an exploded view of an alternate construction of an active jack for wall plate mounting.

FIGS. 26–28 show an alternative embodiment of the active jack construction. PCB housings 286 and 288 are split at a middle point of their assembled height. Offsetting features 292 and 290 (shown in FIG. 28) provide alignment means. This construction allows for full-length and full depth cooling slots 242 in the vertical sides of active jacks, increasing the cooling capabilities of the slot array.

Figure 29:
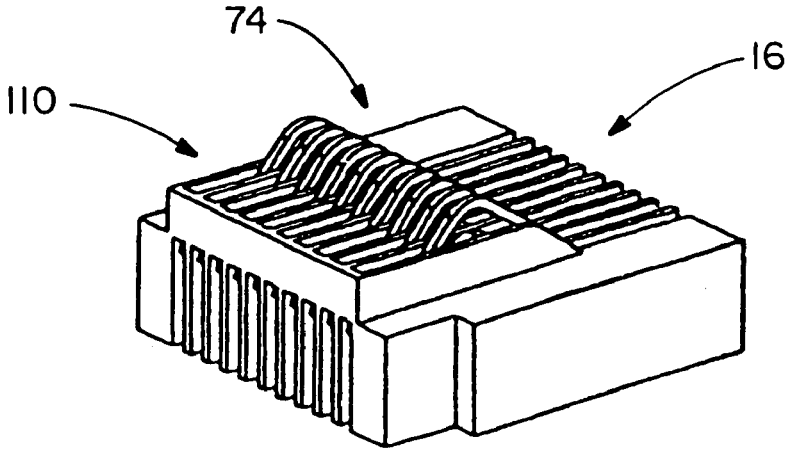
FIG. 29 is a perspective view of a contact carrier with assembled contacts.
Figure 30:
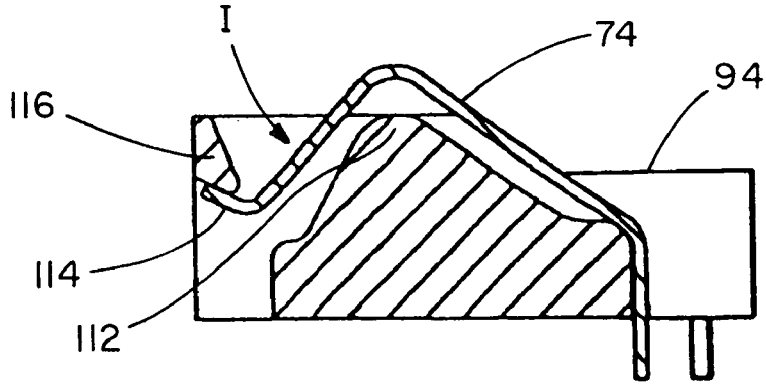
FIG. 30 is a side cutaway view showing a contact.
Figure 31:
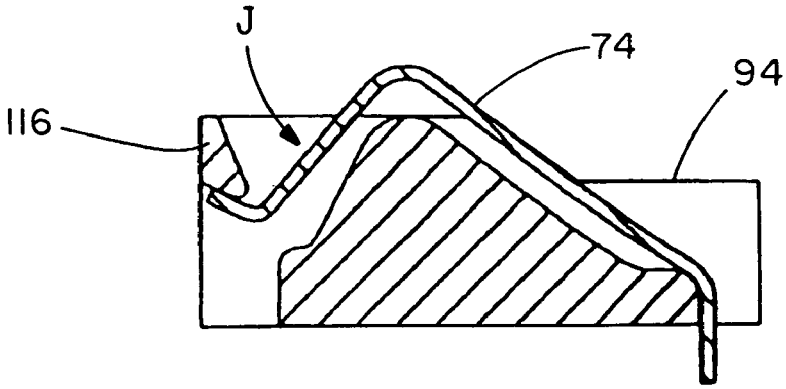
FIG. 31 is a side cutaway view showing another contact.

A contact carrier 16 in which the contacts 74 are seated within contact alignment slots 110 is shown in FIG. 29. To form this completed contact carrier 16, the contacts 74 have been pushed in the direction shown by arrow "I" in FIG. 30 (in the direction of a housing ridge 112 within the contact housing 94) until contact latching ends 114 latch beneath a housing latch 116. Following this step, spring tension within the contacts 74 provides the contacts 74 with freedom of movement in the direction of arrow "J" shown in FIG. 31 and the housing latch 116 prevents the contacts 74 from springing upwardly out of the contact housing 94.

Figure 32:
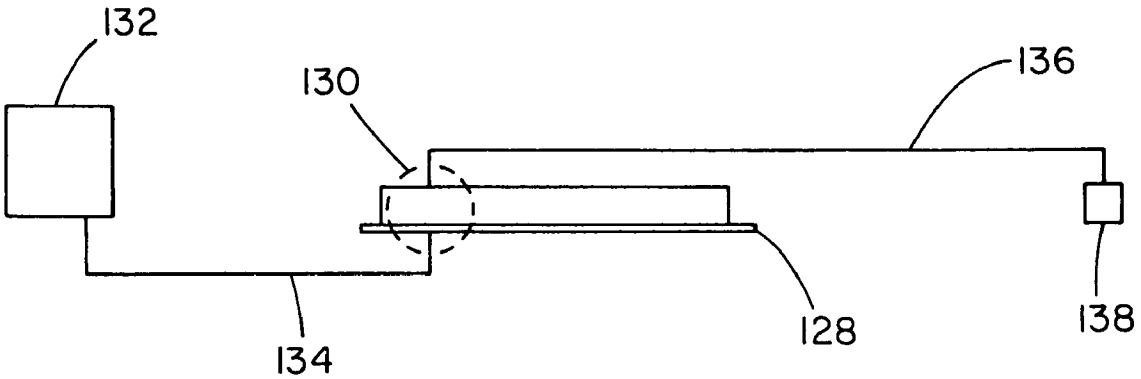
FIG. 32 is a plan view of an inter-connect installation.

The use of fiber optic jacks with patch panels according to the present invention allows for extended runs of cabling with decreased signal degradation and decreased crosstalk. For example, as shown in FIG. 32, a patch panel 128 having fiber optic active jacks 130 installed therein is shown in an inter-connect installation. An active network device such as a switch 132 is connected to the patch panel 128 via a patch cord 134. The fiber optic active jack 130 is adapted to translate signals between the twisted pair cable 134 and a fiber optic cable 136. In the embodiment shown in FIG. 32, the fiber optic cable 136 is connected at its other end to a fiber optic active jack 138, such as a wall jack, which may, in turn, be connected to user-end network devices.

Figure 33:
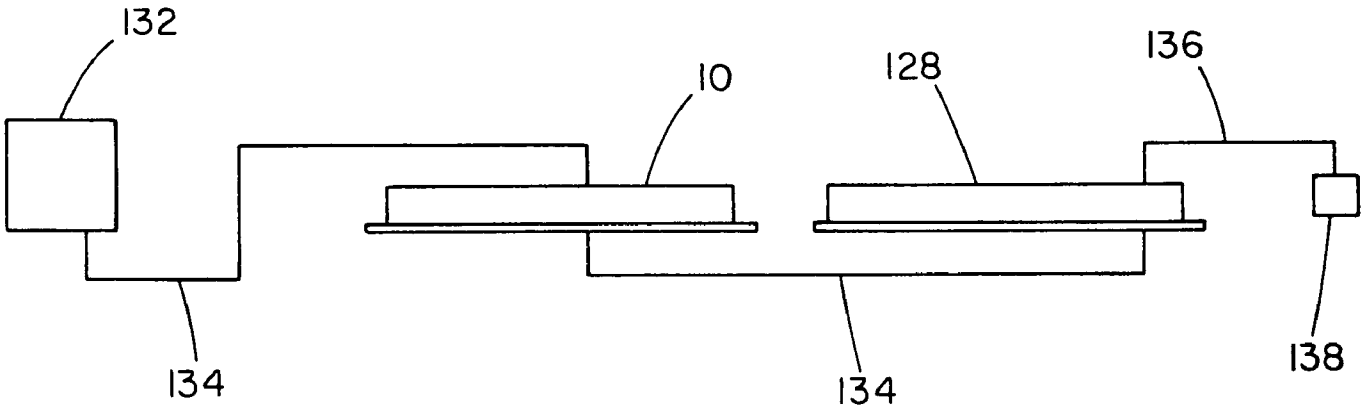
FIG. 33 is a plan view of a cross-connect installation.

Fiber optic compatible active jacks according to the present invention may also be employed in cross-connect systems as shown in FIG. 33. In this embodiment, an active network element such as a switch 132 is connected via a patch cord 134 to a patch panel such as an active-jack patch panel 10. The active-jack patch panel 10 is, in turn, connected to a patch panel 128 populated with fiber optic active jacks via a patch cord 134. Each fiber optic active jack is connected via a fiber optic cable 136 to a fiber optic active jack 138.

Figure 34:
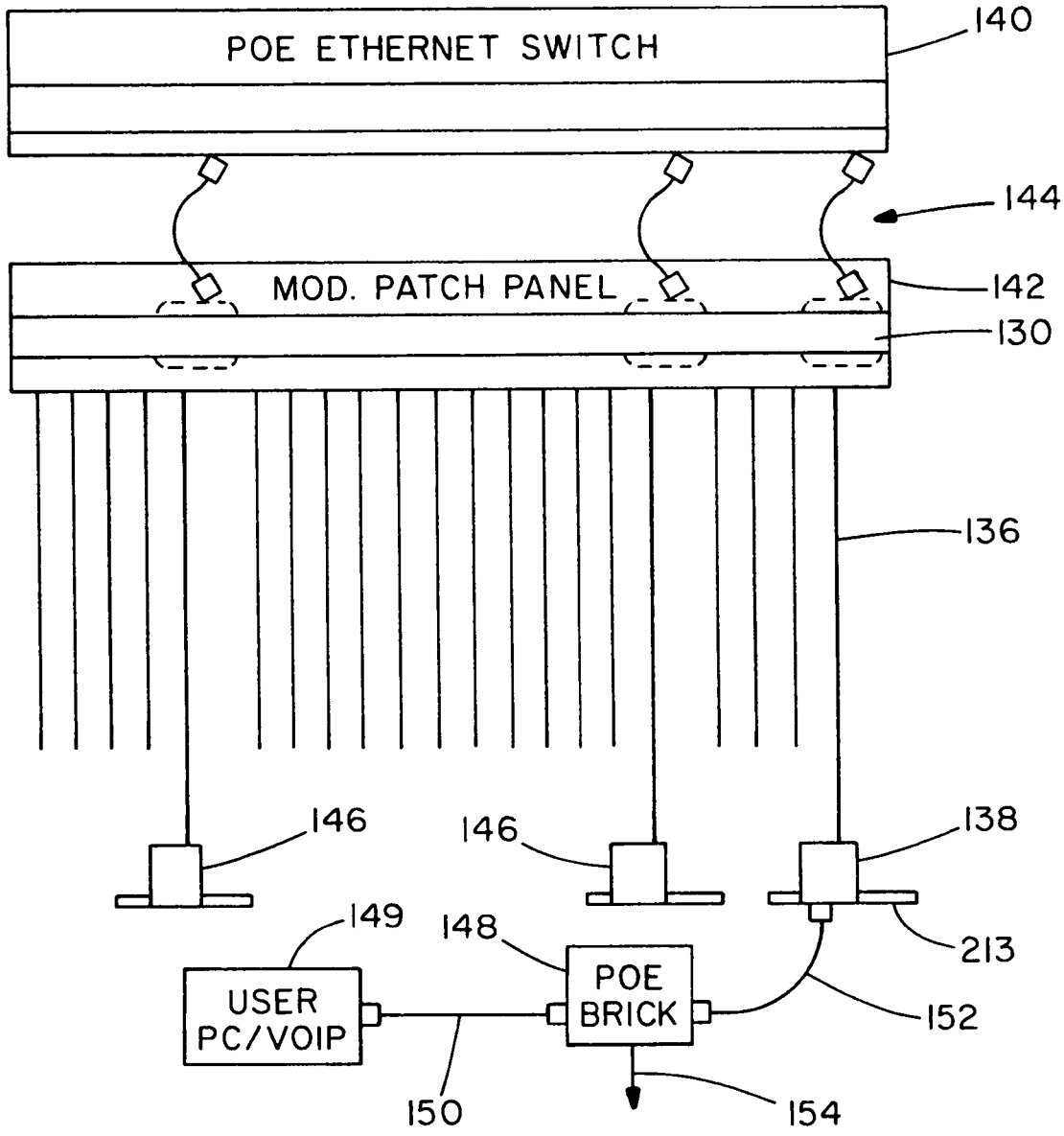
FIG. 34 is a schematic drawing showing a fiber optic and twisted pair cable deployment of a communication system.

The use of fiber optic cables 136 requires the provision of local power to the fiber optic active jack 138. In the embodiment shown in FIG. 34, a PoE Ethernet switch 140 is connected to a modular patch panel 142 via a plurality of patch cords 144. The modular patch panel 142 is connected to the fiber optic active jack 138 via a simplex or duplex fiber optic cable 136 (which may be a single-mode or a multi-mode fiber optic cable). The modular patch panel 142 is connected to twisted-pair active jacks 146 via twisted-pair cables. The fiber optic active jack 138 can receive power from a PoE brick 148. The PoE brick 148 routes power to a user device 149 via a user-side patch cord 150 and routes power to active jacks 138 via a work area patch cord 152. The PoE brick 148 receives power such as AC power from an AC power cord 154. In embodiments such as the embodiment of FIG. 34, twisted-pair active jacks 146 may be provided with power from the PoE Ethernet switch 140, from a mid-span device, or from a powered patch panel. Fiber optic active jacks are addressed as PDs in a PoE deployment. The use of fiber optic cables 136 is beneficial when long connection lengths (for example, greater than 100 m) are necessary. Communication speeds such as 10, 100, or 1000 Mbps are possible, and the same or similar fiber optic active jacks may be located at the patch panel 142 and at destination outlet 213. According to some embodiments, horizontal cabling runs can be changed from twisted-pair runs to fiber optic runs simply by changing two modules and the cable.

Figure 35:
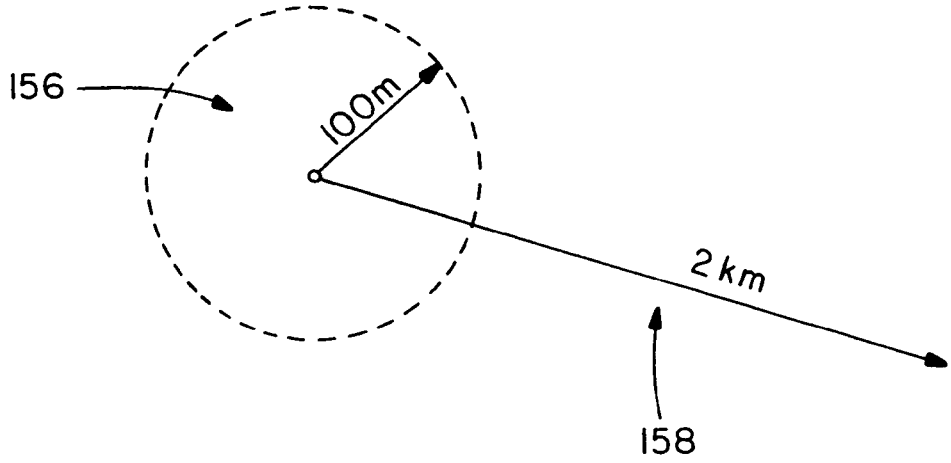
FIG. 35 is a schematic drawing showing cable deployment.
Figure 36:
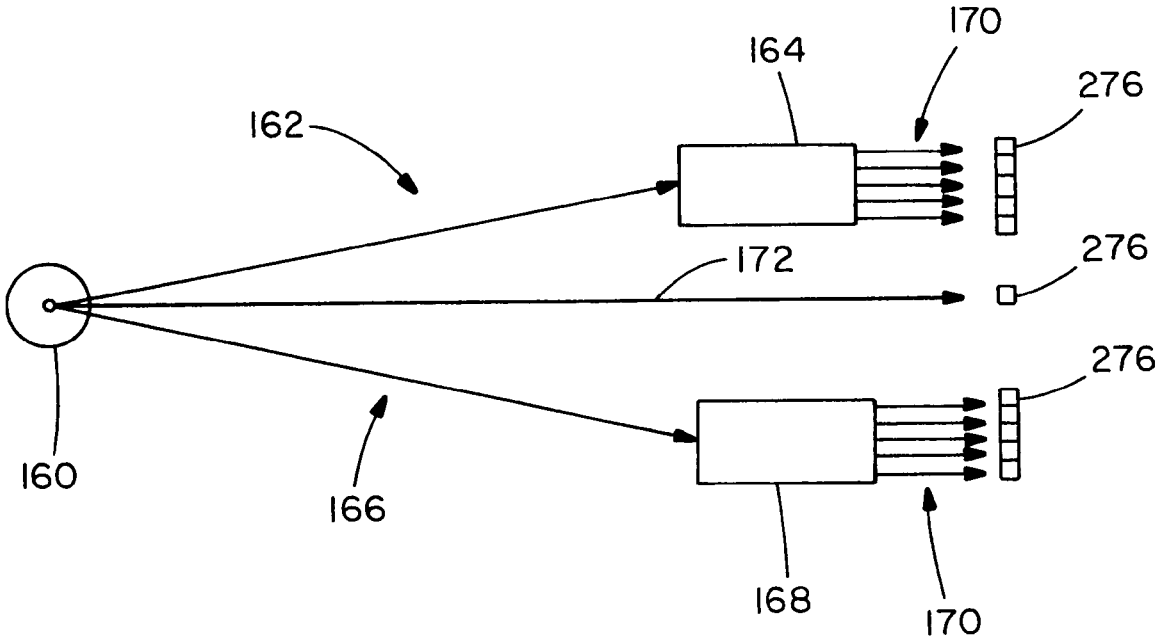
FIG. 36 is a schematic drawing showing fiber optic cable deployment.

FIGS. 35 and 36 show deployment scenarios for fiber optic communications enabled by the present invention. As shown in FIG. 35, a communication network can be divided into zones appropriate for different types of cabling. A twisted-pair (e.g., copper) cabling zone 156 is shown with a range of approximately 100 m of cabling and a fiber optic run 158 is shown for long-range applications. The fiber optic run of FIG. 35 is 2 km long. FIG. 36 shows the use of fiber optic cables with consolidation points and shared media switches. In one embodiment, a patch panel with fiber optic active jacks 160 is connected via a multiple-fiber optic cable 162 to a consolidation point 164. At the consolidation point 164, the multiple-fiber optic cable 162 is translated to individual fiber optic cables 170. Single fibers 166 may be routed between the patch panel with fiber optic active jacks 160 and a shared media switch 168, with the shared media switch 168 being connected to active jacks 276. Finally, a single fiber optic cable 172 may be used to directly connect the patch panel with fiber optic active jacks 160 to active jacks 276. When the consolidation point 164 or shared media switch 168 are used, the user-end connections 170 may be any type of communications cable, as required in the particular deployment.

Figure 37:
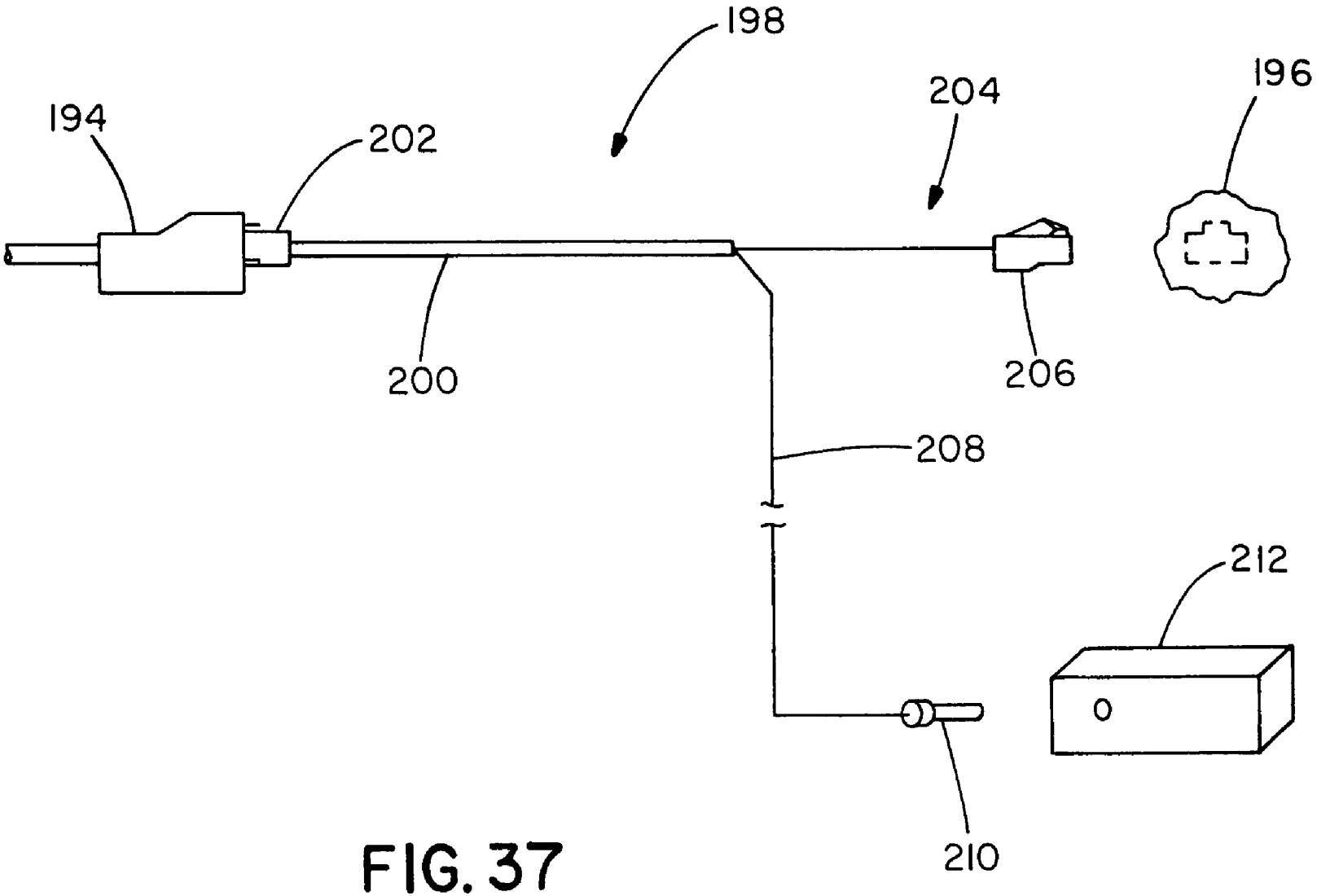
FIG. 37 is a schematic drawing of a power-and twisted pair patch cord.

In some embodiments of the present invention, such as embodiments in which power is not provided to a jack by network-side connections, it is necessary to provide local power to devices. FIG. 37 illustrates a system for providing power to a device, such as a VOIP phone, using a local power supply. A jack 194 is adapted to handle the communications and power-supply needs of a user device 196, such as a VOIP phone. A power-and-data patch cord 198 is provided with a ten-conductor portion 200 that terminates at a plug 202 shown inserted into the jack 194. An eight-conductor portion 204 of the cable 198 terminates at a plug 206 for insertion into the user device 196. A two-conductor portion 208 of the cable 198 terminates at a plug 210 that is inserted into a local power supply 212. In this embodiment, power is routed from the power supply 212 to the jack 202, which re-routes the power necessary for the user device 196 to the user device 196 via the eight-conductor portion 204 of the cable 198.

Systems and methods according to the present invention may be adapted to a number of different types of deployments. For example, Telecommunications Industry Association/Electronic Industries Association ("TIA/EIA") Specification TSB75 includes Consolidation Point (i.e., Zone Enclosure) specifications. It allows one interconnection point within the horizontal cabling from a telecommunications closet to the outlet. The cables on both sides of the consolidation point are part of the same horizontal cable run.

Specification TSB75 specifies, "Moves, adds, and changes of service not associated with open office rearrangements should be implemented at the horizontal cross-connect in the telecommunications closet." Therefore, if an open office rearrangement is made and corresponding changes in the destination of horizontal cabling are made, the network documentation which was manually input when installed must be manually updated. FIGS. 38–46 describe various network infrastructure configurations that utilize active jacks to provide a network documentation and 911 call location system. The 911 call location system includes a table of VOIP phone MAC I.D. numbers vs. the last known physical location of that phone. A phone which is disconnected from the network will remain in the table, however, a call cannot be made from a disconnected phone. If however, the phone is reconnected to the network, the table will be immediately updated with the current location of the phone. This system is therefore online, accurate and provides an immediate answer.

According to some embodiments of systems shown in FIGS. 38–46, every powered device (PD) sends an ARP response immediately following interruption and restoration of its Ethernet signal and/or its power supply. Such a documentation system may be employed with no manual intervention, provided all network infrastructure revisions are confined to changes in patch cord routing and/or changes in which outlets destination devices are connected to. If this procedure is followed, this documentation system will provide online up-to-date documentation, including the horizontal cable locations and identification information which were manually documented when installed and/or revised, and all patch cord routings. The network configurations as illustrated in FIGS. 38–46 do not have a switch in the network path between the P-Jack and the VOIP phone.

With this system, regardless of whether a switch provides power-over-Ethernet, if a patch cord is changed, the signal interruption will trigger an ARP response from the associated P-Jack, and the network path that the P-Jack is on will therefore always be known.

If a destination device (e.g., a VOIP phone) is moved to a new location, the power and/or signal interruption will trigger an ARP response from it, and the network path it is on will always be known. Since the physical locations of all P-Jacks and all outlets are known and all horizontal cables—including those that connect each outlet to a P-Jack—are fixed, complete documentation is known by state-of-the-art software systems.

The physical location of each outlet and the MAC I.D. of the P-Jack to which it is connected can be manually entered into state-of-the-art software by following existing procedures. The validity can be checked by plugging a PD (powered device) with a known MAC I.D. into the outlet and reading the documentation report.

As an alternative, when the installation of a network infrastructure is complete a portable computer (PC) could be plugged into each outlet, one at a time. The work order, which includes the physical locations of the outlets, could be brought up on a screen of the PC and the physical location information could be entered into the system using, for example, a computer mouse. According to one embodiment, software is used to add this fixed location information into the documentation system.

As described in co-pending provisional patent application Ser. No. 60/513,705, filed on Oct. 23, 2003 and entitled "System To Guide and Monitor the Installation and Revision of Network Cabling of an Active Jack Network System," an LED which is visible on the front and back of each P-Jack can assist the revision process. According to one embodiment, software controls each LED, and Ethernet signals received by each P-Jack cause the P-Jacks to turn their LEDs on and off. Therefore, the LED signals in this embodiment can be provided only when the P-Jack is connected to the network. A different color LED on each P-Jack may be used to provide power-over-Ethernet (PoE) information.

Figure 38:
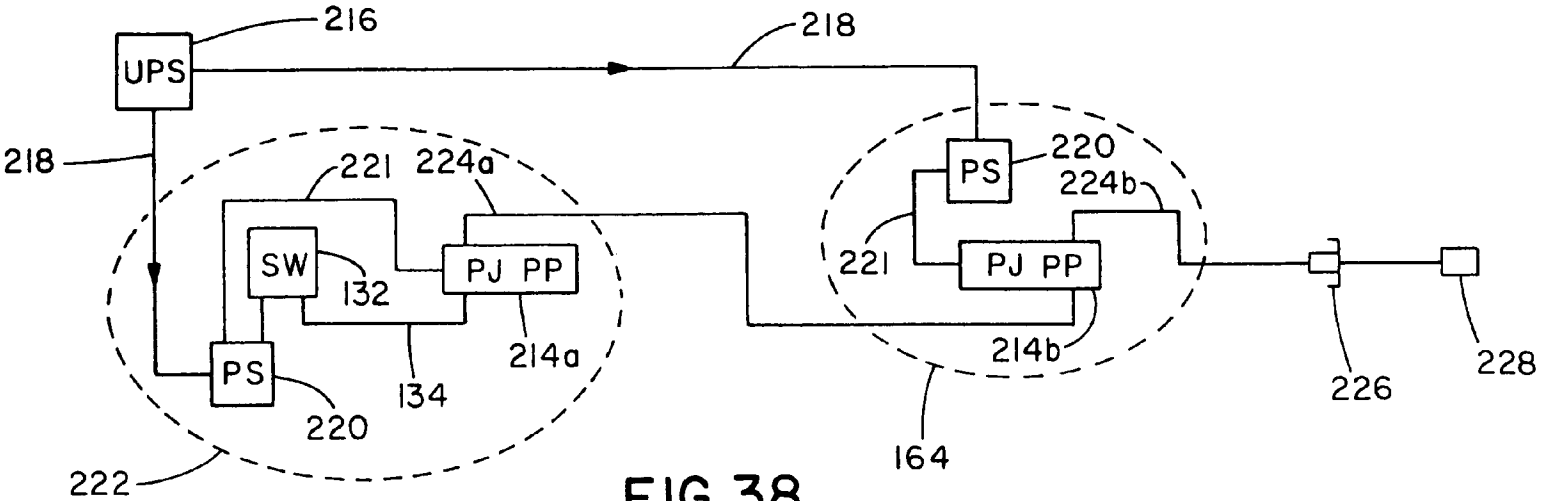
FIG. 38 is a plan view of a power-and-data system in an interconnect-to-interconnect patch panel deployment.
Figure 45:
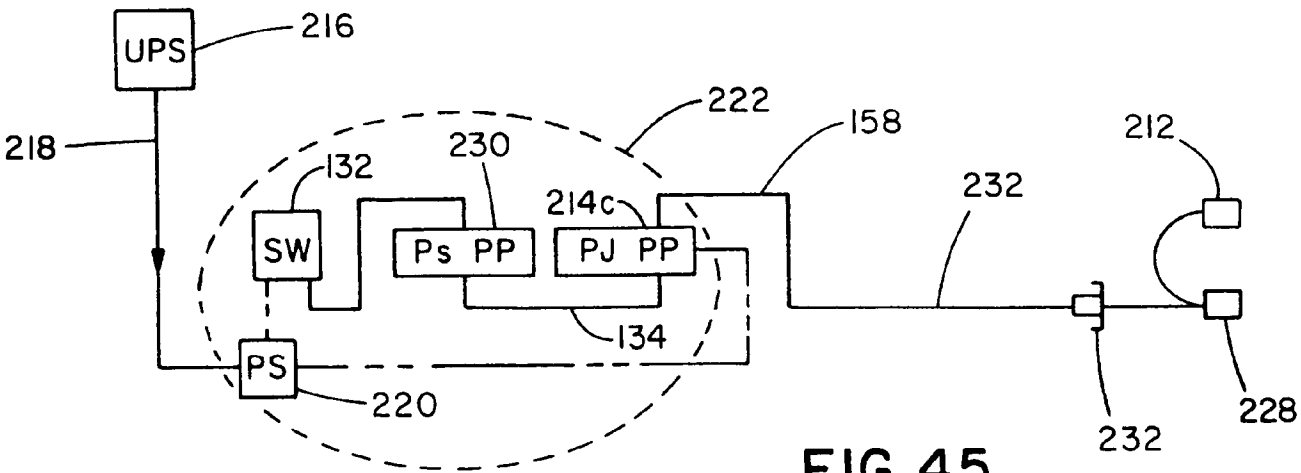
FIG. 45 is a plan view of a power-and-data system in a cross-connect patch panel deployment without a consolidation point and using fiber-optic cable.

Turning now to FIG. 38, a system is shown for providing power and data connections to P-Jack patch panels 214*a* and 214*b*. In the system of FIG. 45, two interconnect patch panel locations are connected with a run of twisted-pair horizontal cable. An uninterruptible power supply (UPS) 216 supplies power (preferably, AC power) along UPS power cables 218 to local UPS power supplies 220. According to one embodiment, the local UPS power supplies 220 are adapted to provide 48 V AC power. The local UPS power supplies 220 provide power to networking equipment via local UPS power supply cables 221. In the embodiment of FIG. 38, two network equipment groups are shown: a communication closet 222 and a consolidation point 164. It is to be understood that the devices shown at the communication closet 222 could be located in alternative locations, such as at a network operations center or other physical location where network equipment is located. The communication closet 222 and the consolidation point 164 are connected in the embodiment of FIG. 45 by a run of twisted-pair horizontal cable 224*a*.

At the communication closet 222 of FIG. 38, the local UPS power supply 220 supplies power to a switch 132 and to the P-Jack patch panel 214*a*. The switch 132 and the P-Jack patch panel 214*a* are connected by a patch cord 134 for carrying data. At the consolidation point 164, the local UPS power supply 220 supplies power to the P-Jack patch panel 214*b* via a local UPS power supply cable 221. The P-Jack patch panel 214*b*, in turn, is connected via a twisted-pair horizontal cable 224*b* to a workstation outlet 226, which in turn is connected to a destination device 228, such as a VOIP phone. According to one embodiment of the deployment shown in FIG. 38, the workstation outlet 226 is a passive jack outlet. Power is supplied to the destination device 228 using PoE.

Figure 39:
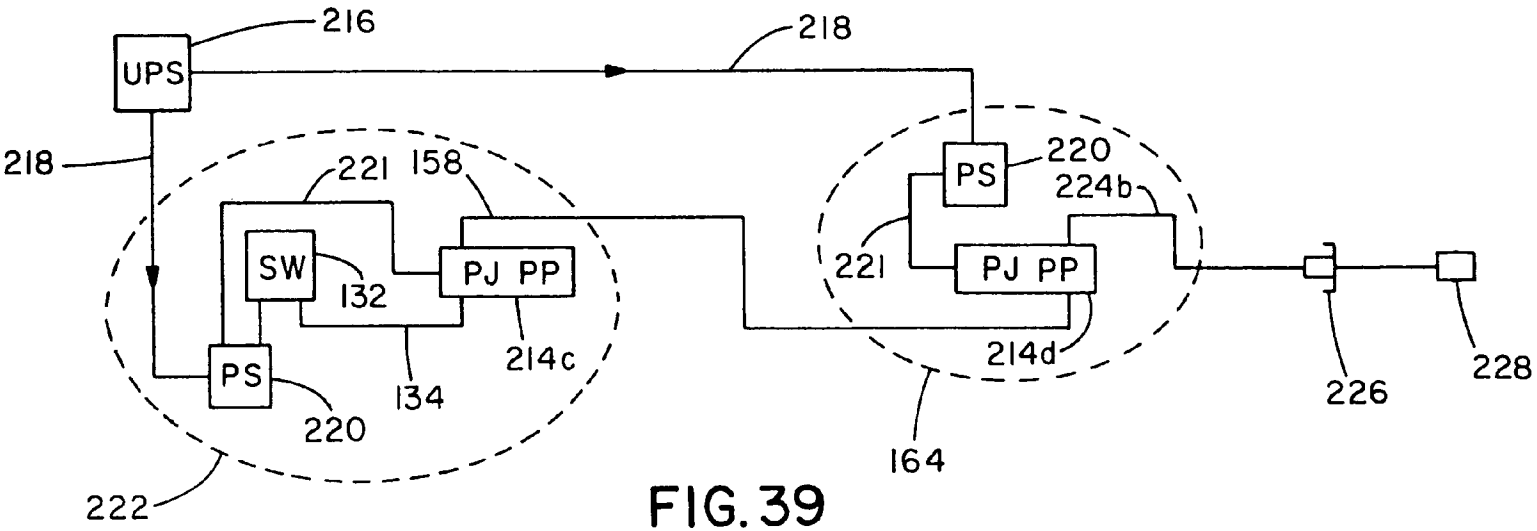
FIG. 39 is a plan view of a power-and-data system in an interconnect-to-interconnect patch panel deployment using fiber optic cable.

Turning now to FIG. 39, a system is shown for providing power and data connections to two interconnect locations connected by a fiber-optic cable. The system of FIG. 39 is similar to the system of FIG. 38, but a fiber-optic cable run 158 serves as the horizontal connection between the two P-Jack patch panels 214*c* and 214*d*. The P-Jack patch panels 214*c* and 214*d* are adapted for fiber-optic communication, as described above.

Figure 40:
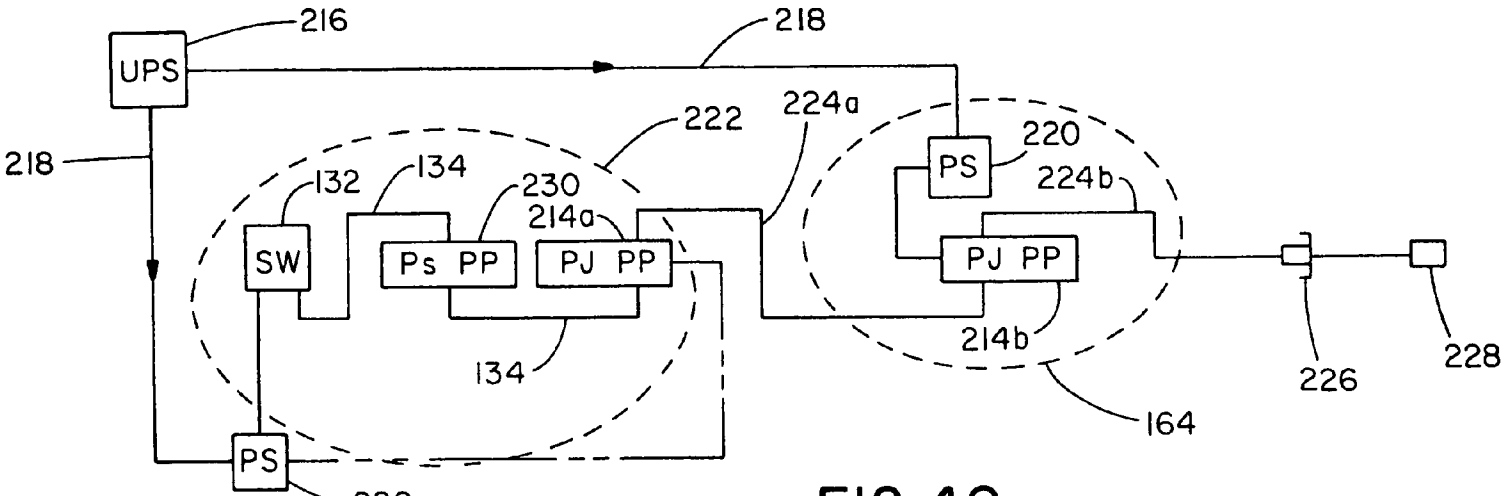
FIG. 40 is a plan view of a power-and-data system in a cross-connect-to-interconnect patch panel deployment.

FIG. 40 shows a system for providing power and data connection between a cross-connect location and an interconnect location connected by a twisted-pair horizontal cable 224*a*. In this embodiment, the communication closet 222 contains two patch panels in a cross-connect configuration. A passive-jack patch panel 230 is cross-connected with a P-Jack patch panel 214*a*. The deployment of this embodiment is similar to the deployment of FIG. 38, with the inclusion of a cross-connect configuration at the communication closet 222.

Figure 41:
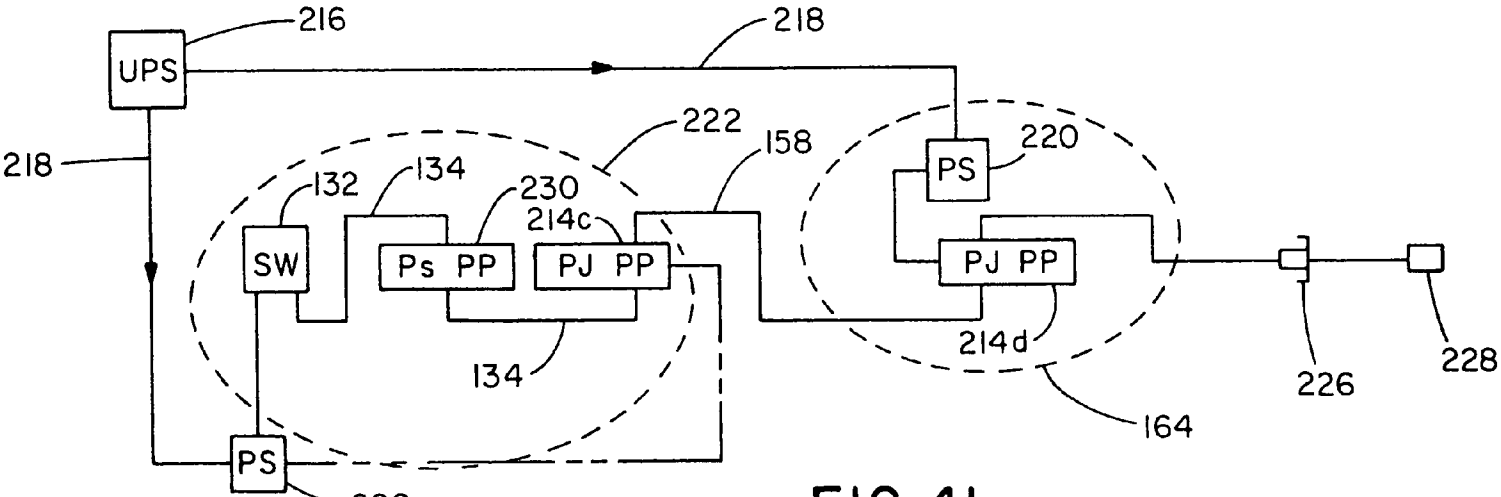
FIG. 41 is a plan view of a power-and-data system in a cross-connect-to-interconnect patch panel deployment using fiber optic cable.

FIG. 41 shows a system for providing power and data connections between a cross-connect location and an interconnect location connected by a fiber-optic cable run 158. The system of FIG. 41 is similar to the system of FIG. 40, with the inclusion of P-Jack patch panels 214*c* and 214*d* adapted for fiber-optic communication over the fiber-optic cable run 158.

Figure 42:
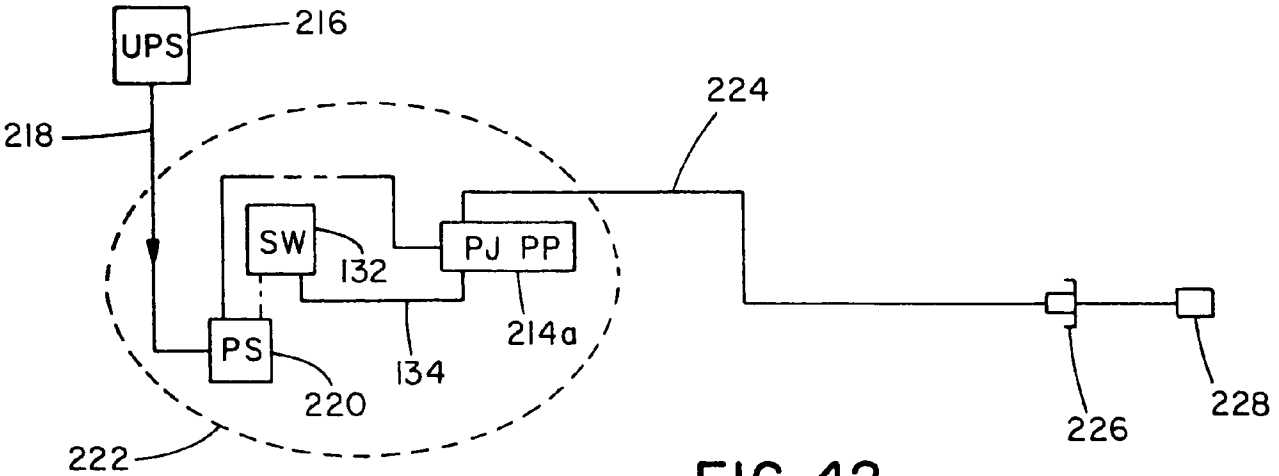
FIG. 42 is a plan view of a power-and-data system in an interconnect patch panel deployment without a consolidation point.

Turning now to FIG. 42, a power-and-data system is shown in which an interconnect patch panel location is deployed without a consolidation point. In this embodiment, the communication closet 222 is an interconnect patch panel location, and the P-Jack patch panel 214*a* is directly connected to a workstation outlet 226 via a twisted-pair horizontal cable 224. As in the embodiments discussed above, a UPS 216 and a local UPS power supply 220 supply power to network components at the communication closet 222.

Figure 43:
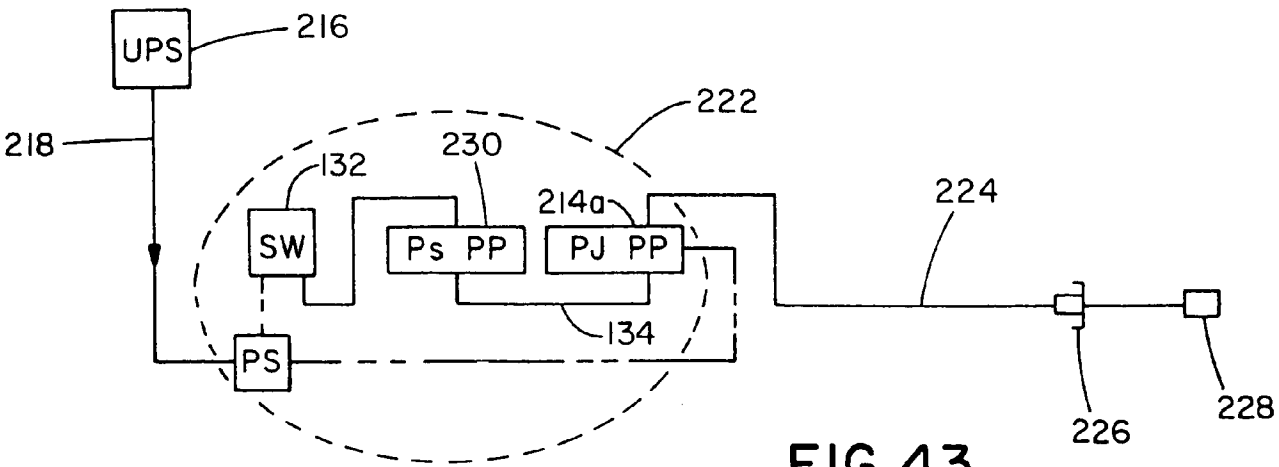
FIG. 43 is a plan view of a power-and-data system in a cross-connect patch panel deployment without a consolidation point.

A similar deployment is shown in FIG. 43, in which a cross-connect patch panel location is deployed without a consolidation point. A passive jack patch panel 230 and a P-Jack patch panel 214*a* are cross-connected at the communication closet 222, and a twisted pair communication cable 224 connects the P-Jack patch panel 214*a* to the workstation outlet 226.

Figure 44:
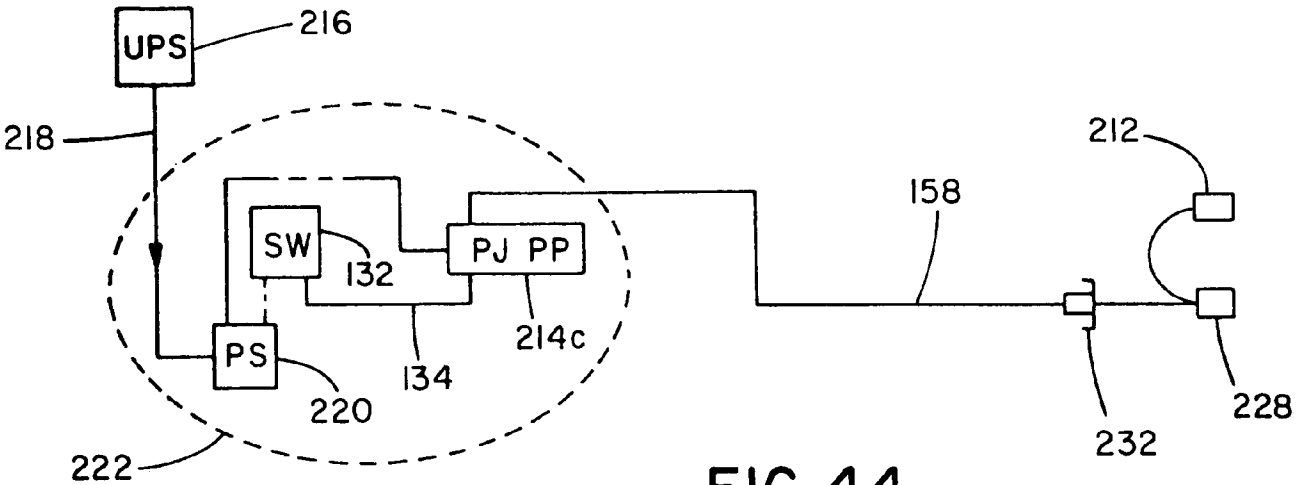
FIG. 44 is a plan view of a power-and-data system in an interconnect patch panel deployment without a consolidation point and using fiber-optic cable.

Turning now to FIG. 44, a deployment is shown in which an interconnect patch panel is connected to an active jack workstation outlet 232 via a horizontal fiber-optic cable run 158, with no consolidation point. Power is supplied to the destination device 228 and to the active jack workstation outlet 232 by a local power supply 212, and the UPS 216 supplies power via a local UPS power supply 220 to the P-Jack patch panel 214*a* and the switch 132.

Similarly, as shown in FIG. 45, systems and methods according to the present invention may be used in a power-and-data deployment in which patch panels in a cross-connect configuration are connected to an active jack workstation outlet 232 via a fiber-optic cable 158. Similarly to the embodiment shown in FIG. 44, a local power supply 212 supplies power to the destination device 228 and the active jack workstation outlet 232. In the embodiments shown in FIGS. 44 and 45, the P-Jack patch panels 214*c* are adapted for fiber-optic communication.

Figure 46:
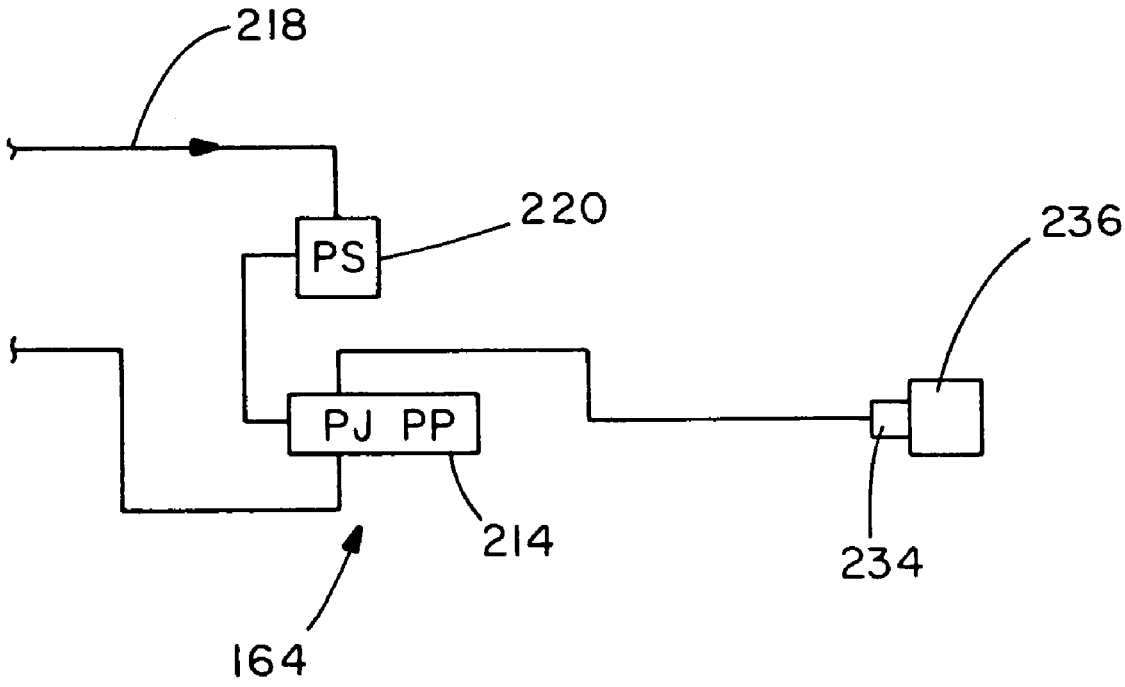
FIG. 46 is a plan view of a power-and-data system having a two-way Ethernet server.

FIG. 46 shows the substitution of a two-way Ethernet server 234 and integral peripheral device 236 for an outlet and destination device. This provides all the functions of an A-Jack, PoE, and an Ethernet interface to the peripheral device. The local UPS power supply 220 and the P-Jack patch panel 214 may be provided at a consolidation point 164.

The network configurations illustrated in FIGS. 38–46 include only one VOIP phone on the same network path as the P-Jack. If an additional VOIP phone is on the same network path, both phones must be in the same proximate location.

While particular embodiments and applications of the present invention have been illustrated and described, it is to be understood that the invention is not limited to the precise assembly and compositions disclosed herein. For example, different blinking patterns or types of indicators may be employed in systems and methods according to the present invention. Various other modifications, changes, and variations may be apparent from the foregoing descriptions without departing from the spirit and scope of the invention as defined in the appended claims.

What is claimed is:

1. A patch panel comprising:

a motherboard having a plurality of contact carriers thereon, each contact carrier supporting a plurality of electrical contacts;

at least one insert that accepts at least a portion of the motherboard; and a modular jack that removably attaches to the at least one insert and that is electrically connected through an electrical connection with at least one electrical contact supported by one of said plurality of contact carriers, wherein the motherboard has circuitry that provides the modular jack with electrical power via the electrical connection, wherein the motherboard provides electrical power to a network powered device via the modular jack over a pair of network cable conductors; wherein the modular jack is an RJ-45 jack.

2. The patch panel of claim 1, wherein the motherboard has circuitry that communicates with the modular jack via the electrical connection.

3. The patch panel of claim 1, wherein the motherboard receives a plurality of modular jacks and wherein the modular jacks may vary with respect to the types of cables that are patched by the respective modular jacks.

4. The patch panel of claim 3, wherein the motherboard has circuitry that provides a common function to the plurality of modular jacks.

5. A modular jack that mounts within a patch panel, the modular jack comprising:

a latch that removably attaches the modular jack within the patch panel;

at least one electrical contact that forms an electrical connection with an electrical contact on a motherboard within the patch panel; and a modular jack circuit board having electronic components that support interaction between the modular jack and the patch panel motherboard via the electrical connection, the modular jack circuit board further having circuitry that receives electrical power from the motherboard and that provides power to a powered device over a pair of conductors within a network cable connected to the modular jack; wherein the modular jack is an RJ-45 jack.

6. The modular jack of claim 5, wherein the modular jack circuit board has circuitry that communicates with the motherboard via the electrical connection.

7. The modular jack of claim 5, wherein the modular jack circuit board has circuitry that supports patching a network connection between two different types of cable connected to the modular jack.

8. The modular jack of claim 5, wherein the modular jack is an active jack and the modular jack circuit board has circuitry that communicates with a network information system over a network cable connected to the modular jack.

9. The modular jack of claim 8, wherein the active jack transmits a media access control identification (MAC ID) in response to a query received from the network information system.

10. An active modular jack that mounts within a patch panel, the active modular jack comprising:

a latch that removably attaches the modular jack within the patch panel;

at least one electrical contact that forms an electrical connection with an electrical contact on a motherboard within the patch panel; and a modular jack circuit board having electronic components that support interaction between the modular jack and the patch panel motherboard via the electrical connection, the modular jack circuit board further having power circuitry that receives electrical power from the motherboard, the active modular jack being adapted to communicate with a network information system over a network cable connected to the active modular jack; wherein the modular jack is an RJ-45 jack.

11. The modular jack of claim 10, wherein the active modular jack transmits a MAC ID in response to a query received from the network information system.

12. The modular jack of claim 10, wherein the modular jack circuit board has circuitry that supports patching a network connection between two different types of cable connected to the modular jack.

* * * * *